US007675004B2

(12) United States Patent
Nakajima et al.

(10) Patent No.: US 7,675,004 B2
(45) Date of Patent: Mar. 9, 2010

(54) HEATING ELEMENT AND PRODUCTION METHOD THEREOF

(75) Inventors: Keizo Nakajima, Osaka (JP); Takahito Ishii, Kyoto (JP); Keiko Yasui, Nara (JP); Seishi Terakado, Nara (JP); Takehiko Shigeoka, Nara (JP); Kazuyuki Kohara, Kyoto (JP); Mitsuru Yoneyama, Nara (JP)

(73) Assignee: Panasonic Corporation, Osaka (JP)

( * ) Notice: Subject to any disclaimer, the term of this patent is extended or adjusted under 35 U.S.C. 154(b) by 782 days.

(21) Appl. No.: 10/592,568

(22) PCT Filed: Mar. 11, 2005

(86) PCT No.: PCT/JP2005/004857

§ 371 (c)(1),
(2), (4) Date: Sep. 12, 2006

(87) PCT Pub. No.: WO2005/089022

PCT Pub. Date: Sep. 22, 2005

(65) Prior Publication Data

US 2007/0193996 A1 Aug. 23, 2007

(30) Foreign Application Priority Data

Mar. 12, 2004 (JP) ..... 2004-070410
Mar. 25, 2004 (JP) ..... 2004-088852
Jun. 15, 2004 (JP) ..... 2004-176807

(51) Int. Cl.
*H05B 3/00* (2006.01)

(52) U.S. Cl. ..... 219/209; 219/211; 338/7

(58) Field of Classification Search ..... 219/209, 219/511, 201, 204, 211, 212, 216, 217, 505, 219/522

See application file for complete search history.

(56) References Cited

U.S. PATENT DOCUMENTS 2,600,485 A * 6/1952 Cox ..... 219/541

(Continued)

FOREIGN PATENT DOCUMENTS

EP 0 386 918 A2 9/1990

(Continued)

OTHER PUBLICATIONS

International Search Report for Application No. PCT/JP2005/004857, dated Jun. 21, 2005.

*Primary Examiner*—Tu B Hoang
*Assistant Examiner*—Vinod D Patel
(74) *Attorney, Agent, or Firm*—RatnerPrestia

(57) ABSTRACT

A heating element includes a base substrate, a pair of electrodes, a resistor capable of generating heat, a conductive resin, a terminal member, a hot melt adhesion metal, a hot melt cohesion metal, and a lead wire. The pair of electrodes is provided on the base substrate, and the resistor is formed between the pair of electrodes. The conductive resin is provided on each of the electrodes, and the terminal member is provided on the conductive resin. The adhesion metal is provided on the terminal member, and the cohesion metal forms a molten phase along with the adhesion metal. An end of the lead wire is welded to the cohesion metal. The conductive resin is provided in the vicinity of the adhesion metal so as to be affected by heat of the adhesion metal.

50 Claims, 10 Drawing Sheets

U.S. PATENT DOCUMENTS

| | | | | | |
|---|---|---|---|---|---|
| 3,182,118 | A | * | 5/1965 | De Proost et al. | 174/94 R |
| 3,207,838 | A | * | 9/1965 | Mccormack | 174/257 |
| 3,931,496 | A | | 1/1976 | Hurko | |
| 4,628,187 | A | * | 12/1986 | Sekiguchi et al. | 219/505 |
| 4,719,317 | A | * | 1/1988 | Reynolds et al. | 174/94 R |
| 4,978,814 | A | * | 12/1990 | Honour | 174/94 R |
| 5,938,957 | A | * | 8/1999 | Tanahashi et al. | 219/219 |
| 6,084,219 | A | | 7/2000 | Winter | |
| 6,967,313 | B1 | * | 11/2005 | Furukawa et al. | 219/465.1 |
| 7,134,201 | B2 | * | 11/2006 | Ackerman et al. | 29/857 |

FOREIGN PATENT DOCUMENTS

| | | | |
|---|---|---|---|
| EP | 05 72 1044 | | 9/2009 |
| GB | 703 584 | A | 2/1954 |
| JP | 53-143047 | | 12/1978 |
| JP | 56-013689 | | 2/1981 |
| JP | 57-154783 | A | 9/1982 |
| JP | 57-202079 | A | 12/1982 |
| JP | 05-174944 | A | 7/1993 |
| JP | 06-096843 | | 4/1994 |
| JP | 07-147183 | A | 6/1995 |
| JP | 08-120182 | | 5/1996 |
| JP | 10-294168 | A | 11/1998 |
| JP | 2003-217904 | | 7/2003 |
| WO | WO 94/03027 | A | 2/1994 |
| WO | WO 04/001775 | A1 | 12/2003 |

* cited by examiner

HEATING ELEMENT AND PRODUCTION METHOD THEREOF

This application is a U.S. National Phase application of PCT International Application PCT/JP2005/004857.

TECHNICAL FIELD

The present invention relates to a heating element that is capable of being used as a heat source in warming for human, heating, and drying, and a method of producing the same.

BACKGROUND ART

A known heating element is disclosed in, for example, WO2004/001775A1. Hereinafter, a constitution of the heating element will be described with reference to the drawings. FIG. 18A is a partially cut-away plan view of a conventional heating element, and FIG. 18B is a sectional view for a main portion of the same.

A silver paste is dried to form a pair of electrodes 112 on flexible base substrate 111 that is formed of a mesh and a film. Resistor 113 is formed between electrodes 112. Terminal portion 114 is formed on an end of electrode 112. Cover material 115 is formed to cover them. In terminal portion 114, terminal member (hereinafter as "member") 116, such as copper foil, is adhered to the end of electrode 112 using conductive adhesive (hereinafter as "adhesive") 117 to be electrically connected to the electrode. Lead wire 119 is connected to another end of member 116 by solder 118.

Lead wire 119 cannot be directly soldered on electrode 112 that is formed by drying the silver paste. Accordingly, member 116 is adhered to electrode 112 using adhesive 117 to form terminal portion 114, and lead wire 119 is soldered on member 116. Thereby, electrode 112 and lead wire 119 are electrically connected to each other.

In this constitution, member 116 and lead wire 119 relatively firmly adhere to each other by solder 118, but physical and electrical adhesion of electrode 112 and member 116 depends on adhesive 117. In the typical conductive adhesive, conductive particles, such as gold, silver, nickel, and carbon, are dispersed in epoxy resin. However, if resin curable in a room temperature is used in consideration of workability, adhesion strength is not enough.

DISCLOSURE OF THE INVENTION

A heating element of the present invention includes a base substrate, a pair of electrodes, a resistor that is capable of generating heat, a conductive resin, a terminal member, a hot melt adhesion metal, a hot melt cohesion metal, and a lead wire. The pair of electrodes is formed on the base substrate, and the resistor is formed between the pair of electrodes. The conductive resin is formed on each of the electrodes, and the terminal member is formed on the conductive resin. The adhesion metal is formed on the terminal member, and the cohesion metal forms a molten phase along with the adhesion metal. An end of the lead wire is welded to the cohesion metal. The conductive resin is formed in the vicinity of the adhesion metal so that the resin is affected by heat of the adhesion metal. In this constitution, a terminal portion that has a high allowable current, firmly adheres to have the high reliability, and has high productivity may be formed on a predetermined position of the heating element.

DETAILED DESCRIPTION OF PREFERRED EMBODIMENTS

Embodiments of the present invention are to be described with reference to the drawings. Those of the same parts are described with reference to identical references, for which detailed descriptions are to be omitted.

First Exemplary Embodiment

Figure 1:
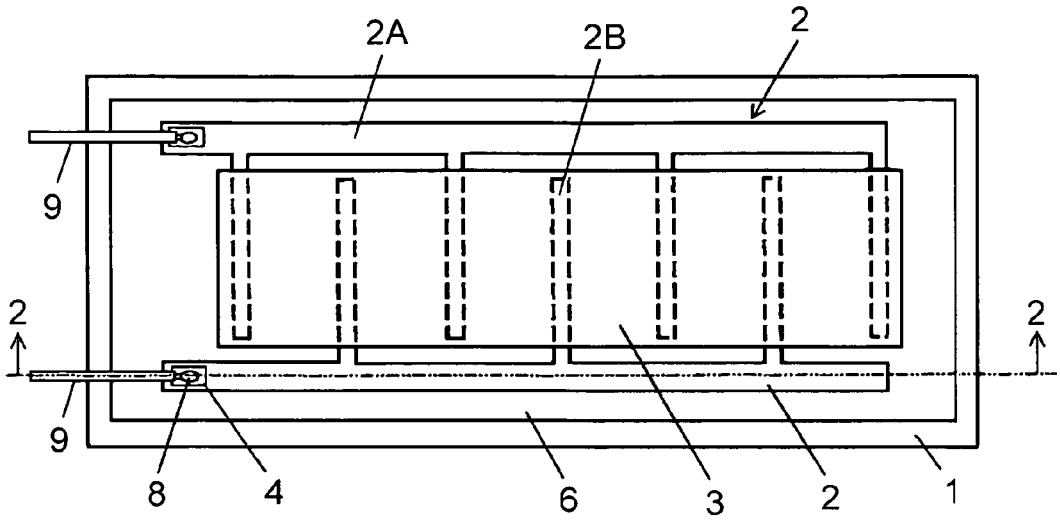
FIG. 1 is a plan view showing a structure of a heating element according to a first exemplary embodiment of the present invention.
Figure 2:
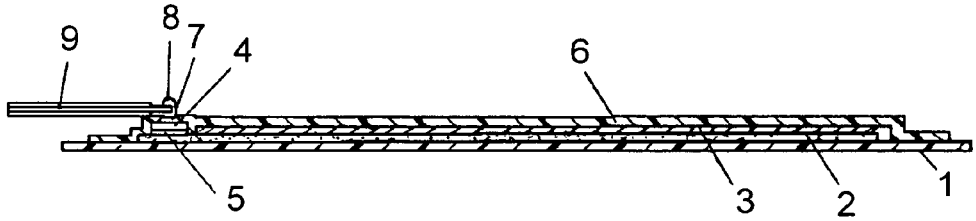
FIG. 2 is a sectional view of the heating element shown in FIG. 1.
Figure 3:
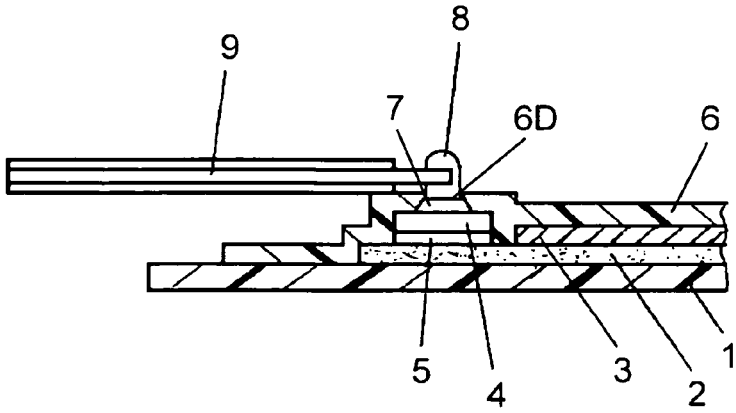
FIG. 3 is an enlarged sectional view for a main portion of the heating element shown in FIG. 1.

FIG. 1 is a plan view showing a structure of a heating element according to the first exemplary embodiment of the present invention, FIG. 2 is a sectional view of the heating element taken along the line 2-2 of FIG. 1, and FIG. 3 is an enlarged sectional view for a main portion of the heating element shown in FIG. 1.

Base substrate 1 is formed of, for example, a polyethylene terephthalate film having a thickness of 188 μm. A conductive silver paste is printed and dried to form a pair of electrodes 2 on base substrate 1. Silver powder is dispersed in co-polyester resin as a conductivity-imparting material, and isocyanate is added as a curing agent in a predetermined amount to produce the conductive silver paste which constitutes electrode 2. That is, electrode 2 includes the resin and conductive powder dispersed in the resin. Electrode 2 includes main electrode 2A and branch electrodes 2B branched from main electrode 2A, and branch electrodes 2B of electrodes 2 that correspond to each other are alternately disposed. Resistor 3 that is capable of generating heat has a positive resistance temperature characteristic, and is formed between electrodes 2. A kneaded substance of carbon black and ethylene vinyl acetate (EVA) copolymer which is crystalline resin is processed to form a paste, printed on a face of electrode 2, and dried to form resistor 3.

The crystalline resin is not limited to EVA. Ethylene-ethylene acrylate copolymer resin (EEA), ethylene-methyl methacrylate copolymer resin (EMMA), or polyolefins such as polyethylene may be used alone or as a combination thereof. Additionally, carbon black may be used alone or in a combination form. Furthermore, any elastomer may be used as long if the elastomer is dissolved in a solvent.

Base substrate 1 on which electrode 2 and resistor 3 are formed is wholly covered with armoring member 6C where, for example, a hot melt resin film having a thickness of 30 μm is layered on a polyethylene terephthalate film having a thickness of 50 μm. Armoring member 6C is formed through hot melting using a laminate roll set at a melting point or higher of the hot melt resin film. As described above, the heating element of the present embodiment has a basic structure including base substrate 1, electrodes 2, resistor 3, and armoring member 6C covering them.

Furthermore, terminal member (hereinafter as terminal) 4 is formed on a power supply part of electrode 2, and electrode 2 and terminal 4 are electrically and physically connected using conductive resin (hereinafter as resin) 5. That is, resin 5 is formed on electrode 2, and terminal 4 is formed on resin 5. Terminal 4 is formed of a copper plate having a thickness of 70 μm. A conductive paste that is produced through dispersion of silver powder as a conductivity imparting material in co-polyester and addition of a predetermined amount of isocyanate as a curing agent is used in resin 5. That is, resin 5 includes a thermosetting material.

Additionally, hot melt adhesion metal 7 is formed on terminal 4, hot melt cohesion metal 8 is fused on an end of lead wire 9, and a molten phase that is formed by adhesion metal 7 and cohesion metal 8 is charged in a hole formed through armoring member 6. That is, armoring member 6 also covers terminal 4 and adhesion metal 7. Adhesion metal 7 and cohesion metal 8 are formed of, for example, solder. Adhesion metal 7 is formed on another side of terminal 4 that is opposite to a side on which resin 5 is formed. Therefore, terminal 4 and lead wire 9 are electrically and physically connected to each other.

Next, a method of producing the heating element of the present embodiment will be described. First, a conductive silver paste is applied to base substrate 1 and dried to form a pair of electrodes 2. At that time, the paste is dried at 150° C. for 30 min so that the co-polyester resin constituting electrode 2 is completely cured due to isocyanate.

Subsequently, a resistor paste is printed between the pair of electrodes 2, and dried at 150° C. for 30 min to form resistor 3. Next, resin 5 is applied on a power supply part of electrode 2, and terminal 4 is situated thereon and then pressed.

Adhesion metal 7 is formed on the center of terminal 4 using a soldering iron. The isocyanate contained in resin 5 is cured due to heat used when adhesion metal 7 is formed, thereby terminal 4 adheres to the power supply part of electrode 2. That is, resin 5 is formed in the vicinity of adhesion metal 7 so as to be affected by heat used when adhesion metal 7 is formed. Next, armoring member 6 is bonded by hot-melting using a laminate roll having a surface temperature of 170° C. to produce a main body of the heating element.

Next, lead wire 9 is connected to terminal 4 to complete the production of the heating element. Cohesion metal 8 is previously fused on an end of lead wire 9, and is pressed on a surface of armoring member 6 that covers adhesion metal 7 and is formed on terminal 4 while cohesion metal 8 is heated using the soldering iron. At that time, armoring member 6 is melted due to heat of the soldering iron and, and adhesion metal 7 on terminal 4 and cohesion metal 8 fused on the end of lead wire 9 are integrally melted at the same time.

Consequently, a phase in which adhesion metal 7 and cohesion metal 8 are melted and thus attached to each other fills through hole 6D of armoring member 6 to form the molten phase and to complete electric and physical connection of terminal 4 and lead wire 9. In this constitution, breaking strength of lead wire 9 is about 10 kgf, and a portion attached using resin 5 has breaking strength of the above-mentioned value or more, thus desirable endurance is assured for practical use. Furthermore, even though continuous electric current of 5 A is applied to the terminal portion, an increase in temperature is 2 K or less. This does not cause any problem with respect to practical use.

Terminal 4 that is formed on the power supply part of electrode 2 is attached to electrode 2 through resin 5. Accordingly, even though electrode 2 is made of a material in which silver powder is dispersed in a co-polyester resin, that is, the so-called cured conductive paste resin, it is possible to achieve electric and physical connection. Additionally, even though a metal thin film is used as electrode 2, it is possible to achieve the electric and physical connection. Hence, it is possible to attach terminal 4 with no respect to the type of material of the electrode. Further, since resin 5 is formed at a position that is affected by heat used when adhesion metal 7 and cohesion metal 8 are melted and adhere, resin 5 is cured desirably. Thus, adhesion strength of resin 5 is high. Since resin 5 is interposed in a thin shape, resistance of the adhering portion is very low, and little heat is generated even though the large current is continuously applied. Furthermore, a sufficient adhesion area ensures enough strength.

Since armoring member 6 formed outside terminal 4 supports terminal 4, the adhesion is made still firmer. Adhesion metal 7 and cohesion metal 8 that are heated at melting temperatures or more are bonded by hot-melting via through hole 6D provided by hot melting of armoring member 6, thereby the metals are welded. The welding is conducted between metals, and electrode 2 and lead wire 9 are electrically and physically connected firmly.

Since through hole 6D that is formed through armoring member 6 is filled with cohesion metal 7 or adhesion metal 8, airtightness is maintained. Terminal 4 can be formed at an arbitrary position of electrode 2, and a change of a connection position of lead wire 9 is easy. Further, in no relation to the position of terminal 4, it is possible to connect lead wire 9 after armoring member 6 is provided. Consequently, the power supply part that has a large allowable current, high reliability, and high productivity can be formed at a arbitrary position of the heating element. In case a great amount of current is needed since voltage of an electric source is low, or in case a heating element that has a positive resistance temperature characteristic and requires a large inrush current to obtain flash heating is to be formed, the above-mentioned constitution is very effective.

Electrode 2 is curable by heating, and is cured by heating before resin 5 is adhered to electrode 2. Hot melting is easy to conduct with respect to electrode 2 before the heat curing, but strength that is required as an object to be adhered is reduced. Thus, insufficient adhesion strength is obtained between terminal 4 and electrode 2. The uncured conductive resin paste is applied to electrode 2 after the heat curing, and is cured by heating to form resin 5, thereby desirable adhesion strength required in the power supply part is assured.

Next, another method of producing the heating element shown in FIG. 1 will be described. FIGS. 4A to 4D are sectional views sequentially illustrating the production of the heating element shown in FIG. 1.

Figure 4A:
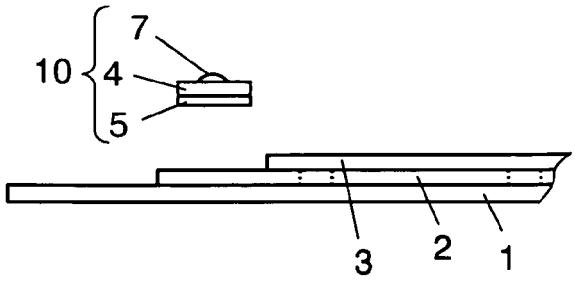
FIGS. 4A to 4D are sectional views sequentially illustrating the production of the heating element shown in FIG. 1.
Figure 4B:
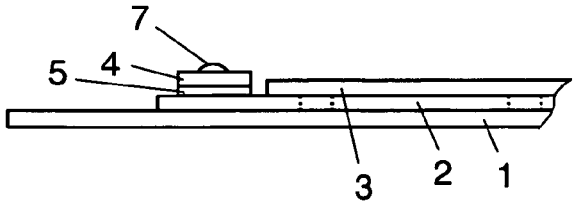

First, as shown in FIG. 4A, a conductive silver paste is printed on base substrate 1, and dried to form the pair of electrodes 2. Subsequently, the resistor paste is printed and dried at 150° C. for 30 min to form resistor 3. Meanwhile, resin 5 is formed on a first surface of terminal 4, and adhesion metal 7 is formed on a second surface that is opposite to the first surface. Thereby, terminal part 10 is prepared in advance. As shown in FIG. 4B, the surface on which resin 5 is formed is set to come into contact with electrode 2 so as to provide terminal part 10 on the power supply part of electrode 2.

Figure 4C:
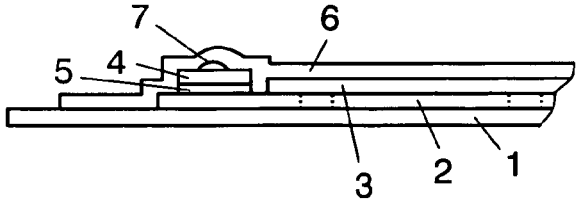

Next, as shown in FIG. 4C, armoring member 6 is bonded by hot-melting using a laminate roll having a surface temperature of 170° C. to complete a main body of the heating element. Resin 5 is bonded by hot-melting on electrode 2 through heating and pressing using the laminate roll. As described above, resin 5 includes the co-polyester resin and isocyanate. Since the heating using the laminate roll causes initiation of a curing reaction of co-polyester using isocyanate that is unreacted by that time, resin 5 and electrode 2 adhere.

Figure 4D:
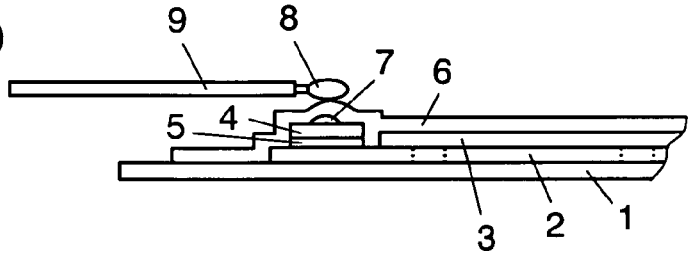

Next, lead wire 9 is connected to terminal 4 to finish the production of the heating element. As shown in FIG. 4D, cohesion metal 8 is melted on the end of lead wire 9 in advance. While cohesion metal 8 is heated with the soldering iron, cohesion metal 8 is tightly pressed on the surface of armoring member 6 that covers adhesion metal 7 formed on terminal 4. At this time, armoring member 6 is melted due to heat of the soldering iron, and adhesion metal 7 and cohesion metal 8 are integrally melted at the same time. Consequently, a phase in which adhesion metal 7 and cohesion metal 8 are melted and adhere to each other fills through hole 6D that is formed through the melting of armoring member 6, and the molten phase is formed. At the same time, the electric and physical connection of terminal 4 and lead wire 9 is completed. At this time, the curing reaction of co-polyester is progressed due to heat and adhesion of resin 5 and electrode 2 is made firm.

In the method of producing the heating element as described above, resin 5 is formed on a surface of terminal 4 that comes into contact with electrode 2, and adhesion metal 7 is formed on another surface to produce terminal part 10. In this constitution, it is not needed to separately form resin 5, terminal 4, and adhesion metal 7 on a portion of electrode 2 to which lead wire 9 is to be attached. That is, since only disposing of terminal part 10 on the connection portion of lead wire 9 is needed, the constitution is very simple. Therefore, processing accuracy is improved and processing time is significantly shortened.

As described above, the conductive paste in which the silver powder as the conductivity imparting agent is dispersed in co-polyester and a predetermined amount of isocyanate is added as the curing agent is used as resin 5. In this step, resin 5 is dried at low temperatures so that the curing reaction does not occur due to isocyanate. That is, the material constituting resin 5 contains the curing agent having the limited reactivity at a predetermined temperature or lower. In connection with this, the predetermined temperature means a temperature to which resin is heated when adhesion metal 7 and cohesion metal 8 are integrally melted.

In the process of forming resin 5 on terminal part 10, some heat treatments are required in many cases. The curing agent having the limited reactivity at a predetermined temperature or lower is contained, thereby it is possible to perform the heat treatment in an unreaction state of the curing agent. Since the curing agent is treated in the unreaction state, a hot melting property is maintained when resin 5 adheres to electrode 2. Thus, resin 5 can adhere to electrode 2 with heat. After the hot adhesion, resin 5 is heated to a reaction temperature of the curing agent or higher to be cured. Thereby, the firm adhesion strength of resin 5 that is intrinsic property of resin is obtained.

Furthermore, the curing agent having the limited reactivity at a predetermined temperature or lower is contained to maintain an uncured state for a long time. Accordingly, thermoplasticity is maintained, and, if resin 5 is pressed at a melting point or higher, resin 5 can adhere to electrode 2 by hot melting. Additionally, since electrode 2 and resin 5 include the same resin material that is co-polyester, a heat melting property is excellent and sufficient heat melting strength is obtained.

Figure 5:
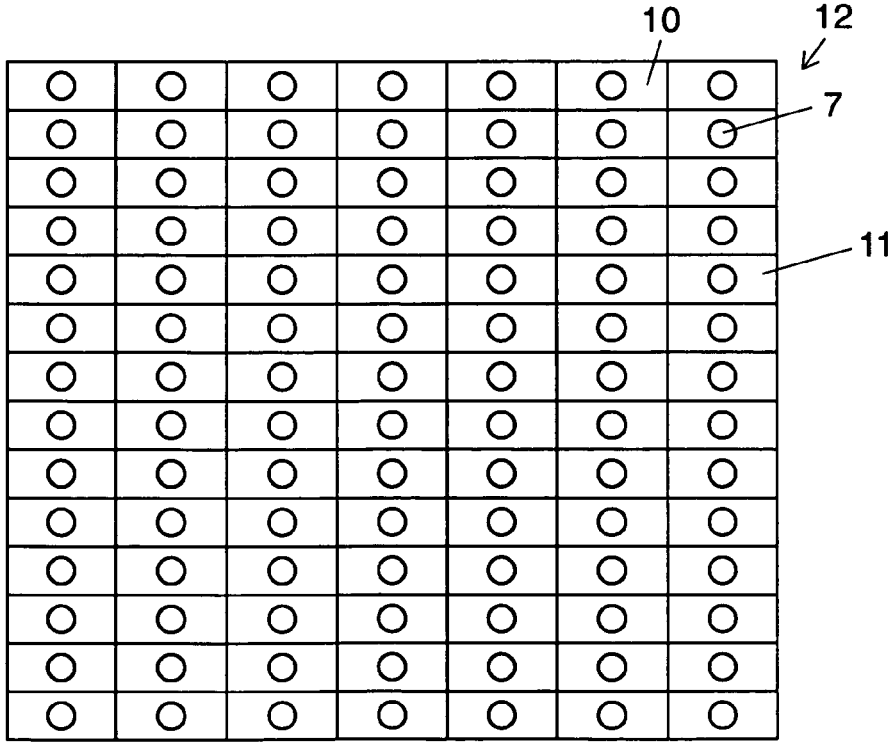
FIG. 5 is a plan view illustrating a structure of a terminal part that is used in the heating element according to the first exemplary embodiment of the present invention before being divided.
Figure 6:
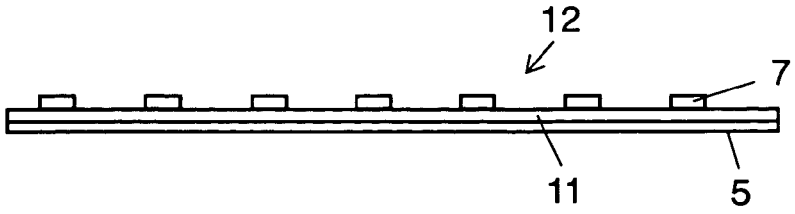
FIG. 6 is a side view of the terminal part shown in FIG. 5 before being divided.

Next, a method of producing by dividing terminal part 10 in which terminal 4, resin 5, and adhesion metal 7 are united will be described. FIGS. 5 and 6 are a plan view and a side view of a structure of the terminal part that is used in the heating element of the present embodiment before being divided, respectively. In assembly 12 of terminal parts 10 before the division, adhesion metals 7 having a diameter of 8 mm are arranged on a first surface of terminal plate 11, and resin 5 is formed on a second surface that is opposite to the first surface. Assembly 12 is cut to produce terminal parts 10.

Next, a method of producing assembly 12 will be described. First, a cream solder is printed on a first surface of terminal plate 11 that is formed of a copper plate having a thickness of 70 μm and is larger than terminal 4 to form a circular pattern having a diameter of 8 mm, and heated in an oven at 23° C. to form adhesion metal 7. Since the cream solder may be processed by printing, there are advantages in that productivity is excellent, shaping is easy, and the thickness is constant. Therefore, it is preferable to use the cream solder as adhesion metal 7. That is, air inclusion or breaking of armoring member 6 caused by unevenness may be avoided using a laminate process when armoring member 6 is formed. Therefore, the cream solder may be applied to the above-mentioned other method.

Subsequently, a conductive paste for forming resin 5 is applied on an entire surface of a back face (second surface) of terminal plate 11 through the screen printing and dried at 100° C. for 30 min to remove a solvent.

In order to form resin 5 on terminal plate 11 by a printing process or the like, it is necessary for the conductive resin material to be uncured and to have suitable flowability.

Accordingly, it is preferable that a solvent be contained to provide the flowability.

In the conductive paste for forming resin 5, the curing agent is added to cure the co-polyester which is the main component of the resin, and block-type isocyanate that is not cured at a temperature of 130° C. or lower is used. Therefore, in this step, the solvent of resin 5 is dried to remove. That is, when terminal plate 11 for making terminals 4 adheres to resin 5, the solvent is almost completely removed. Meanwhile, since the resin component is uncured, the resin component has thermoplasticity, thus it is possible to conduct hot melting with respect to electrode 2. In a heat curing process, foaming caused by the solvent does not occur and the dense structure is assured, thereby strength is significantly improved.

Thereby, assembly 12 in which terminal plate 11, resin 5, and adhesion metal 7 are united is divided at a broken line portion of FIG. 5 to produce terminal parts 10 required in terminal connection. Terminal part 10 is precisely and reasonably produced.

It is preferable that the adhesion surface of the terminal and resin 5 be roughed instead of using a metal thin plate, such as a copper plate, as terminal 4. Thereby, the adhesion surface area to resin 5 is increased to increase peeling strength. The copper plate may be roughed so that ends of prominences on the roughed surface are wider with respect to the height. Thereby, an anchor effect is provided, thus still more increasing the peeling strength. Examples of the roughing method include surface grinding, plating of metal that is different from metal for forming terminal 4 using electric or chemical process, and etching. Electroplating may provide the anchor effect.

It is preferable to use an electrolytic metal foil as terminal 4. Thereby, it is possible to apply the foil having the uniform thickness and high purity, and sufficient conductivity is obtained even though the thickness is reduced. Accordingly, it is possible to form terminal 4 having excellent flexibility. In case the electrolytic metal foil is used as terminal 4, the above-mentioned roughing stands for that, concavity and convexity of 0.5 to 9.5 μm height are formed.

Furthermore, it is preferable to use a rolled metal foil as terminal 4. Thereby, a property in which breaking does not easily occur with respect to elongation is provided, thus it is possible to form terminal 4 having excellent bend resistance.

It is preferable to plate metal having corrosion resistance on a surface of terminal 4. Thereby, contact resistance may be reduced, or an increase of a resistance value caused by deterioration due to oxidation may be suppressed. In case the olefin-based resin is used, plating on a copper foil can reduce pollution by copper. A plating material may be selected from metals, such as nickel, tin, and solder, which have resistance to oxidation and do not inhibit conductivity.

Figure 7:
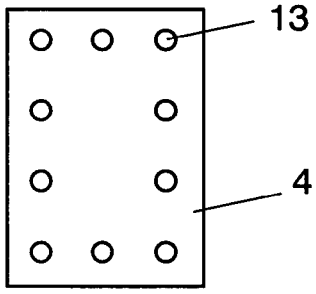
FIG. 7 is a plan view of a terminal member that is used in the heating element according to the first exemplary embodiment of the present invention.

As shown in FIG. 7, it is preferable to use the material through which opening 13, such as a polygonal hole and a round hole, is formed as the material of terminal 4. Thereby, resin 5 is provided into an edge or a rear side of the opening of terminal 4, thus adhesion strength is significantly improved. This constitution is very effective with respect to the case where predetermined strength of terminal 4 is required, and the shape, number, and arrangement of openings 13 may be appropriately set to significantly improve strength.

Figure 8:
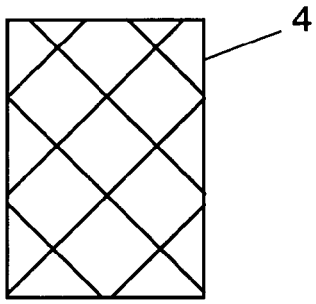
FIG. 8 is a plan view of another terminal member that is used in the heating element according to the first exemplary embodiment of the present invention.

As shown in FIG. 8, it is preferable to use a fibrous material as the material of terminal 4. Thereby, since resin 5 is input into the fibrous portion of terminal 4, adhesion strength is significantly improved. Additionally, flexibility can be provided, and terminal 4 having excellent bend resistance is formed.

Figure 9:
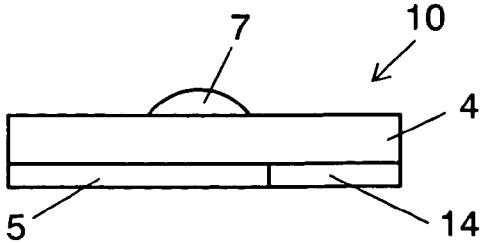
FIG. 9 is a side view of the terminal part that is used in the heating element according to the first exemplary embodiment of the present invention.

As shown in FIG. 9, it is preferable to juxtapose resin 5 and adhesive material 14 on the adhesion side of terminal 4 to electrode 2. Adhesive material 14 may reinforce the physical connection of resin 5 and electrode 2, and improve the reliability required as terminal part 10. Due to adhesibility of adhesive material 14, it is facilitated to temporarily fix terminal part 10 to a portion at a predetermined position. Thereby, the productivity is improved and the positional precision is also improved.

Typically, the power supply part is processed such as resin-molded with the object of electric insulation, sealing, and reinforcement. This constitution may be applied to the present embodiment, thereby increasing the reliability of the power supply part.

Resin 5 is not limited to co-polyester, but may be selected from many resins having reactivity, such as epoxy, silicone, and acryl. The curing agent is not limited to isocyanate, but may be selected from various materials according to the type of resin. Co-polyester is a resin having excellent hot melting property and is cured due to isocyanate. Since co-polyester is flexible even after the curing, terminal 4 and electrode 2 are firmly adhered while flexibility of the terminal and the electrode is maintained. Consequently, it is possible to improve the reliability with respect to various stresses, such as deformation and an impact.

Second Exemplary Embodiment

Figure 10:
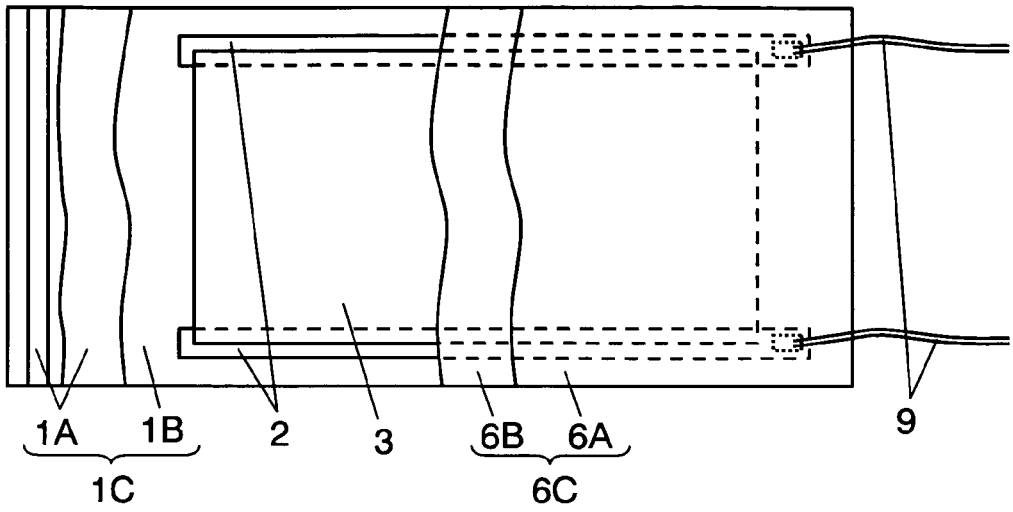
FIG. 10 is a plan view illustrating structures of heating elements according to second to eleventh exemplary embodiments of the present invention.

FIG. 10 is a plan view showing a heating element according to a second exemplary embodiment of the present invention. In the present embodiment, base substrate 1C includes first reinforcing layer 1A and first resin layer 1B, and armoring member 6C includes second reinforcing layer 6A and second resin layer 6B. A power supply part of each electrode 2 has the same configuration as that of the first embodiment.

Reinforcing layer 1A includes nonwoven fabrics that are laminated. The nonwoven fabrics includes a nonwoven fabric in which polyethylene terephthalate fibers, that is, polyester-based materials are entangled, and a nonwoven fabric in which polyethylene terephthalate long fibers are arranged in a predetermined direction. Since the long fibers have high tensile strength, the retractility thereof can be restricted in a direction where the long fibers are arranged. Further, since the long fibers have high bulk density, the long fibers do not have the same physical property as a cushioning material. On the other hand, the nonwoven fabric in which fibers are entangled without orientation does not restrict the elongation of the fibers well since stress is not directly applied to the fibers. In addition, since the bonding force between the fibers is small, the fibers have low bulk density. For this reason, the fibers have the same physical property as a cushioning material.

Resin layer 1B is formed by melt extrusion of a thermoplastic urethane elastomer having a melting point of 160° C. so as to have a thickness of 50 μm. Resin layer 1B is very flexible, and can be free to expand and contract in all directions. Furthermore, resin layer 1B has the same physical property as a cushioning material, as well as rubber elasticity. In addition, a thermoplastic elastomer is an elastomer that can be thermoformed, and very facilitates a process of forming resin layer 1B. In particular, an olefin-based thermoplastic elastomer that is made of ethylene, propylene, and ethylene propylene is preferably used as the thermoplastic elastomer. The olefin-based thermoplastic elastomer is a material that has a property of an elastomer, and high resistance against temperature or chemicals in a process of forming a resistor, and a physical property indispensable to a heating element such as a low hygroscopic property. When the olefin-based thermoplastic elastomer is used as the thermoplastic elastomer, it is possible to obtain a heating element that has retractility, stable resistance characteristic, and very high reliability.

Although resin layer 1B is attached to reinforcing layer 1A, reinforcing layer 1A and resin layer 1B are integrally laminated by hot-melting not to be impregnated, thereby forming base substrate 1C. Since base substrate 1C has a laminated structure and does not have an impregnated structure, base substrate 1C has a particular physical property where physical properties of layers of base substrate 1C are added to each other. That is, when tensile stress is applied to the substrate, the base substrate expands by the distinctive retractility thereof. However, the base substrate does not expand in a specific direction.

A conductive paste is applied on resin layer 1B of base substrate 1C, and then dried to form a pair of electrodes 2. Since a direction where the pair of electrodes 2 faces each other agrees with a direction where the long fibers of reinforcing layer 1A are arranged, the retractility is restricted in a direction where the pair of electrodes 2 faces each other. The conductive paste contains epoxy resin, and silver particles that are dispersed in the epoxy resin to allow the epoxy resin to have conductivity. Resistor 3 has a positive resistance temperature property. A paste of a kneaded material that includes ethylene-vinyl acetate copolymer and carbon black is applied on a surface, on which electrodes 2 are formed, of resin layer 1B and then dried to form resistor 3. A pair of lead wires 9 is provided to the respective power supply parts of electrodes 2.

Resin layer 6B is formed of co-polyester to have a melting point of 120° C. so as to have a thickness of 50 μm. In particular, co-polyester having a grade of excellent flexibility and retractility is used as resin layer 6B. Reinforcing layer 6A is a nonwoven fabric in which polyethylene terephthalate fibers are entangled. Resin layer 6B and reinforcing layer 6A are laminated by hot-melting to form armoring member 6C. Armoring member 6C is laminated on an entire surface, on which resistor 3 is formed, of base substrate 1C by hot-melting to seal the entire surface of base substrate 1C. That is, resin layer 6B is bonded to resin layer 1B by hot-melting.

Reinforcing layer 6A has a physical property that allows the reinforcing layer to easily expand by tensile stress but not to restitute. Meanwhile, resin layer 1B having a property of an elastomer expands by tensile stress, and restitutes when the tensile stress is removed. If reinforcing layer 6A is impregnated with resin layer 6B, the tensile strength is increased and a force of restitution is developed. In particular, it is possible to improve the entanglement and orientation of the fibers in a processing direction during a process of entangling polyethylene terephthalate fibers. If the above-mentioned materials are impregnated with resin layer 6B, reinforcing layer 6A has a physical property that allows the reinforcing layer to hardly expand and contract in the processing direction but to expand and contract in other directions. This is due to the fact that the entanglement and orientation of the fibers are improved by the impregnation of resin layer 6B. For this reason, it is possible to obtain an advantage of high breaking strength.

Further, since a polyester-based material has a small thermal contraction ratio and high strength, the polyester-based material is suitable for a material for reinforcing resin layer 1B or resin layer 6B which have a property of an elastomer and whose dimensions are likely to be unstable. Furthermore, the polyester-based material is a material that has high resistance against temperature, tension, or chemicals in a process of forming resistor 3, and a physical property indispensable to a heating element such as a high insulating property and low hygroscopic property.

Reinforcing layer 6A may include a knitted layer. Since the knitted layer has low extensional rigidity against tensile stress, the knitted layer does not restrict the retractility. Meanwhile, in case of armoring member 6C composed of resin layer 6B and reinforcing layer 6A including the knitted layer, if reinforcing layer 6A is impregnated with resin layer 6B, entanglement points of the knitted layer are hardened so as to sufficiently restrict the retractility. Since the knitted layer impregnated with resin layer 6B has a high breaking strength in a knitted direction, the knitted layer very efficiently restricts the retractility.

Further, reinforcing layer 6A may include a nonwoven fabric layer formed by the entanglement of the fibers. Since the nonwoven fabric layer has low extensional rigidity against tensile stress, the nonwoven fabric layer does not restrict the retractility. Meanwhile, in case of armoring member 6C including resin layer 6B and reinforcing layer 6A that is composed of the nonwoven fabric layer formed by the entanglement of the fibers, reinforcing layer 6A is impregnated with resin layer 6B. Accordingly, entanglement points of the nonwoven fabric layer are hardened so as to sufficiently restrict the retractility. Since the nonwoven fabric layer impregnated with resin layer 6B has a high breaking strength in a processing direction, the nonwoven fabric layer very efficiently restricts the retractility.

In the present embodiment, a direction where armoring member 6C hardly expands agrees with a direction where the pair of electrodes 2 faces each other. Therefore, in case of the heating element according to the present embodiment, base substrate 1C and armoring member 6C restrict the retractility in the same direction.

Electrodes 2 and resistor 3 are formed on resin layer 1B, and are deformed as resin layer 1B expands and contracts. Resin layer 6B can be bonded on resin layer 1B by hot-melting, and covers the entire surface of resin layer 1B and electrodes 2 and resistor 3 formed thereon, so as to serves as an electric insulating layer and a protective layer. The retractility of base substrate 1C including resin layer 1B and reinforcing layer 1A, and that of armoring member 6C including resin layer 6B and reinforcing layer 6A are restricted by reinforcing effects of reinforcing layers 1B and 6B in a direction where a voltage is applied to resistor 3 via the pair of electrodes 2. For this reason, the expansion and contraction in that direction, which is caused by tensile stress, is restricted.

Material of resin layer 1B is selected so that the melting point thereof is 40K higher than that of resin layer 6B. That is, resin layer 1B does not melt at the melting point of resin layer 6B. Therefore, even though armoring member 6C is melted by a laminating roll whose surface temperature is 150° C. so as to be bonded on base substrate 1C by hot-melting having resistor 3, the thermal deformation of base substrate 1C is very small. Therefore, the change in dimension, which causes practical problems, does not occur.

Figure 11:
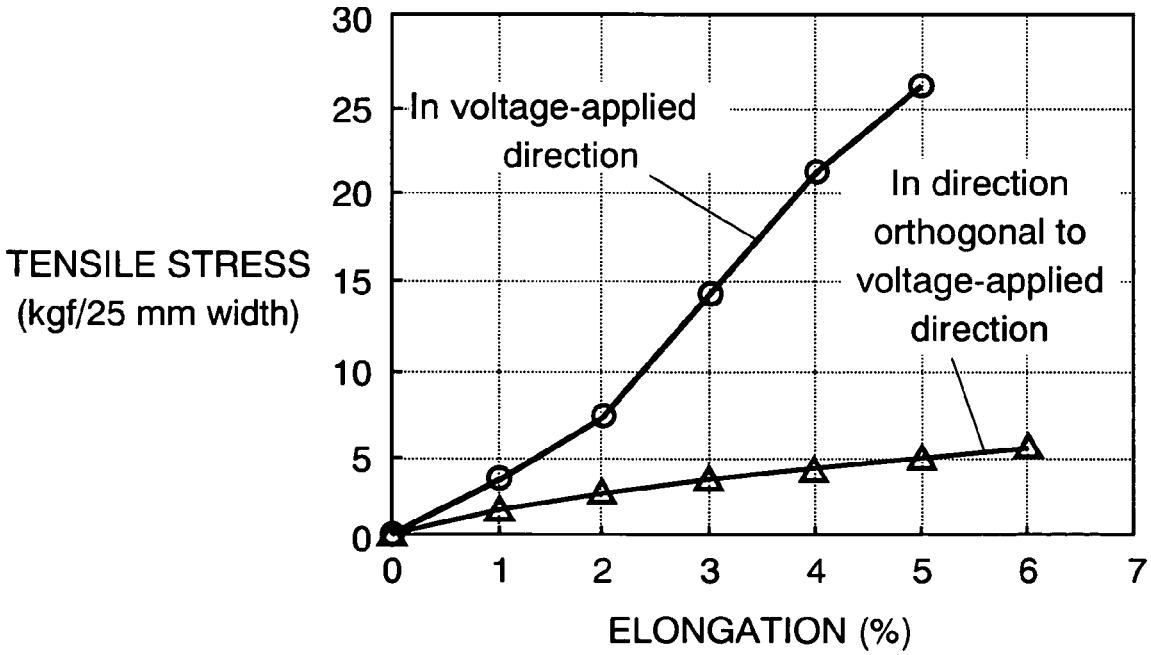
FIG. 11 is a graph showing tensile properties of the heating element shown in FIG. 10.

Next, results of evaluating a tensile characteristic and stability of the resistance value of the heating element manufactured as described above will be described below. FIG. 11 is a graph showing a tensile characteristic of the heating element shown in FIG. 10 in which the elongation of the heating element is restricted in a direction where a voltage is applied to resistor 3. The evaluation of the stability of the resistance value is performed as follows: that is, a sphere having a radius of 120 mm is prepared, and the heating element is pressed against the surface of the sphere via a cushioning member to deform the heating element in three dimensions. After repeatedly pressing the cushioning member against the surface of the sphere, resistance values are measured. In the present embodiment, the heating element is configured so that a direction where the pair of electrodes 2 faces each other, that is, a direction where a voltage is applied to resistor 3 agrees with a direction where the elongation of base substrate 1C and armoring member 6C is restricted. In addition, a heating element (a comparative sample) where the directions are orthogonal to each other is also manufactured and evaluated to compare the characteristics.

Figure 12:
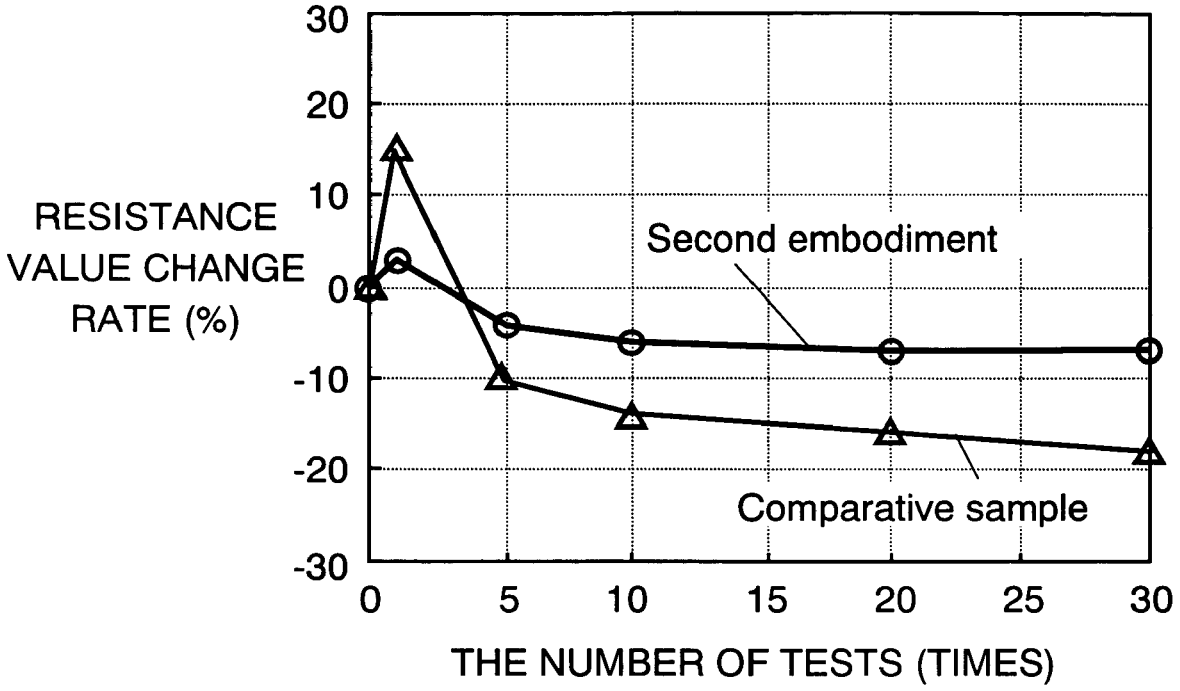
FIG. 12 is a graph showing reliability properties of the heating element shown in FIG. 10.

FIG. 12 is a graph showing reliability characteristics that are results of the evaluation. As is clear from FIG. 12, the heating element according to the present embodiment has higher stability resistance value than the comparative sample. It is considered that the reason is due to the following mechanism:

According to the heating element of the present embodiment, the retractility is restricted by reinforcing effects of reinforcing layers 1A and 6A in a direction where a voltage is applied to resistor 3. For this reason, relative displacements of conductive particles in resistor 3 decrease. Therefore, the variation of resistance value is suppressed to be small. A direction where the variation of the resistance value is suppressed to be small agrees with a direction where the resistance value of the heating element is determined, that is, a direction where a voltage is applied to the resistor. Accordingly, the variation of resistance value of the heating element is suppressed to be small. Meanwhile, even though the comparative sample includes reinforcing layers 1A and 6A, the retractility is not restricted in a direction where a voltage is applied to resistor 3. For this reason, relative displacements of conductive particles in resistor 3 increase. Therefore, the variation of resistance value increases. A direction where the variation of the resistance value increases agrees with a direction where the resistance value of the heating element is determined, that is, a direction where a voltage is applied to the resistor. Accordingly, the variation of resistance value of the heating element increases. Even though the variation of the resistance value caused by the retractility occurs in a direction different from the direction where a voltage is applied to resistor 3, the direction where the variation of the resistance value occurs does not agree with a direction where the resistance value of the heating element is determined, that is, a direction where a voltage is applied to the resistor. Therefore, the resistance value of the heating element does not reflect the variation of the resistance value.

As described above, according to the heating element of the present embodiment, the expansion and contraction are restricted in a specific direction. However, the expansion and contraction are not restricted in other directions. Therefore, the heating element can be free to be mounted to a heated object having three-dimensional curved surfaces. Further, by orienting a direction where the heating element can expand and contract to a direction where the retractility is required, the heating element can achieve retractility. Furthermore, since a direction where the heating element can expand and contract is a direction which does not contribute to the resistance value of the heating element, it is possible to obtain the retractility and the stability of the resistance value at the same time.

According to the present embodiment, a nonwoven fabric in which polyethylene terephthalate fibers are entangled, and a nonwoven fabric in which polyethylene terephthalate long fibers are arranged in a predetermined direction are laminated to be used as reinforcing layer 1A. Since the nonwoven fabric in which polyethylene terephthalate fibers are entangled has a small bonding force between the fibers, the bulk density thereof is low, thereby is poor at restricting the elongation. However, the nonwoven fabric has a physical property that absorbs vibration energy, that is, the same physical property as a cushioning material. Meanwhile, the nonwoven fabric in which long fibers are arranged in a predetermined direction so as to restrict the retractility thereof is able to restrict the retractility; however, it hardly has the same physical property as a cushioning material.

A material having a property of an elastomer such as a thermoplastic urethane elastomer has the same physical property as a cushioning material, as well as rubber elasticity. Therefore, even though vibration is applied to the material having a property of an elastomer, only dull vibrating sound occurs. Meanwhile, when a material where the long fibers are arranged in a predetermined direction is mixed in the material having a property of an elastomer, the mixed material has rubber elasticity. However, since the mixed material does not absorb vibration energy, loud vibrating sound may occur. The above-mentioned physical properties are different from the property of a common elastomer, and may be not desirable in some cases. The nonwoven fabric in which polyethylene terephthalate fibers are entangled included in reinforcing layer 1A is a material for giving the same physical property as a cushioning material to the reinforcing layer. Since the reinforcing layer includes the above-mentioned nonwoven fabric, it is possible to form a heating element that has rubber elasticity and the same physical property as a cushioning material.

The combination of the materials of reinforcing layers 1A and 6A is not limited to the above-mentioned combination. Reinforcing layer 1A restricts the retractility in a specific direction, and has the same physical property as a cushioning material. Therefore, even though reinforcing layer 1A is used as reinforcing layer 6A, it is possible to obtain the same effect as described above. Further, reinforcing layer 6A can have a physical property that restricts the retractility in a specific direction by being impregnated with resin layer 6B, as well as the same original physical property as a cushioning material. Therefor, even though the nonwoven fabric in which fibers are entangled is used as both reinforcing layer 1A and 6A, it is possible to obtain the same effect as described above.

When reinforcing layer 1A includes a structure in which long fibers are arranged in a predetermined direction, even though a high-melting point resin or a resin having low flowability, which is difficult to be impregnated, is used as resin layer 1B, it is possible to obtain a physical property that restricts the retractility in a specific direction. Accordingly, the reinforcing layer is suitable to be used as a heat resistant substrate in a process such as a drying process after printing. When reinforcing layer 6A including only the nonwoven fabric in which fibers are entangled, reinforcing layer 6A can be impregnated with resin layer 6B in the laminating process. Therefore, reinforcing layer 6A is valuable to be used as an armoring member.

Even though only one of base substrate 1C and armoring member 6C has the above-mentioned structure, it is possible to obtain the same effect as described above. Further, the retractility of one of base substrate 1C and armoring member 6C may be restricted by the long fibers arranged in a predetermined direction of the reinforcing layer, and the other thereof may be impregnated with the resin layer so as to restrict the retractility.

Third Exemplary Embodiment

A heating element according to the present embodiment has the same configuration as the heating element shown in FIG. 10 except for the configuration of base substrate 1C and the material of electrodes 2. That is, a thermoplastic urethane-based elastomer forming resin layer 1B and a nonwoven fabric in which polyethylene terephthalate fibers are entangled forming reinforcing layer 1A are laminated at high temperature and pressure to form base substrate 1C so that the nonwoven fabric is impregnated with the thermoplastic urethane-based elastomer. Reinforcing layer 1A also includes the same long fibers as the second embodiment. A co-polyester resin-based conductive paste having higher flexibility is used to form electrodes 2.

If a conductive paste where silver particles are dispersed in the co-polyester resin to allow the co-polyester resin to have conductivity and a solvent is added to the co-polyester resin to adjust viscosity is used in the second embodiment, it is possible to improve the flexibility of electrodes 2. However, after the conductive paste is applied, small convexoconcave occurs on resin layer 1B by a swelling. In this case, although resistor 3 can be printed, the deviation of the resistance value increases. If the co-polyester resin-based conductive paste is applied on a surface of resin layer 1B without reinforcing layer 1A, very large convexoconcave occurs as large as the resistor cannot be printed.

In contrast, according to the present embodiment, after the co-polyester resin-based conductive paste is applied, swelling does not occur. In addition, trace of swelling does not appear after drying. Accordingly, it is not difficult to apply and dry resistance paste afterward, and the deviation of the resistance value does not increase. It is considered that the reason is the following fact. That is, since reinforcing layer 1A is partially impregnated with resin layer 1B, the displacement of resin layer 1B is restricted by the impregnation while the displacement caused by the swelling tends to deform resin layer 1B so that the convexoconcave may occur.

Therefore, even in the case that resin layer 1B is made of a material that easily swells such as a thermoplastic urethane-based elastomer, if resin layer 1B is impregnated into reinforcing layer 1A, resin layer 1B can be used in base substrate 1C. This mechanism can be applied to the conductive paste of resistor 3 as well as the conductive paste of electrodes 2. Therefore, the mechanism is can be applied to improve resistor 3. When resin layer 1B swells, resin layer 1B comes into adherence with the conductive paste well in many cases. Therefore, it is possible to form electrodes 2 and resistor 3 that are not easily peeled off even though base substrate 1C repeatedly expands and contracts.

Namely, when electrodes 2 or resistor 3 is formed, resin layer 1B swells by the solvent contained in electrodes 2 or resistor 3. However, reinforcing layer 1A suppresses the expansion caused by swelling of resin layer 1B. Although having different degrees, the swelling occurring on resin layer 1B is a phenomenon where resin layer 1B temporarily expands. If it is possible to suppress the expansion, any fault does not remain in a process after the drying process. When resin layer 1B tends to swell and expand, reinforcing layer 1A restricts the swelling, the swelling does not occur in appearance. Since the solvent is removed after the drying process, the swelling disappears. Therefore, any fault does not remain in appearance.

A thermoplastic urethane-based elastomer is one of resins that have the most excellent property, and has an excellent retractility. Furthermore, the thermoplastic urethane-based elastomer can be processed to have a small thickness. A thermoplastic ester-based elastomer has an excellent retractility, and adheres tenaciously to reinforcing layer 1A. However, the elastomers tend to swell by various solvents. For this reason, when the elastomers are used as base substrate 1C, there are many cases where electrodes 2 and resistor 3 cannot be formed using a method of applying thereon. Accordingly, the above-mentioned structure has a significant effect.

As described above, according to the heating element of the present embodiment, reinforcing layer 1A restricts the expansion and contraction in a specific direction and suppresses the swelling of base substrate 1C caused by the conductive paste. The heating element having this configuration has the same effect as that according to the second embodiment. In addition, since a direction where the heating element can expand and contract is not a direction which contributes to the resistance value of the heating element and base substrate 1C adheres tenaciously to electrodes 2 or resistor 3, it is possible to improve the retractility and the stability of the resistance value at the same time.

According to the present embodiment, resin layer 1B and reinforcing layer 1A are laminated at high temperature and pressure to form base substrate 1C so that an outer layer of the nonwoven fabric, forming reinforcing layer 1A, in which polyethylene terephthalate fibers are entangled is impregnated with a thermoplastic urethane-based elastomer forming resin layer 1B. That is, resin layer 1B is formed on the surface of the nonwoven fabric that is formed by fiber-entanglement and laminated in reinforcing layer 1A.

Even though resin layer 1B and reinforcing layer 1A are laminated at high temperature and pressure to form base substrate 1C so that an outer layer of the nonwoven fabric in which polyethylene terephthalate long fibers are arranged in a predetermined direction instead of the nonwoven fabric in which polyethylene terephthalate fibers are entangled is impregnated with the thermoplastic urethane-based elastomer, it is possible to obtain the same effect as described above. However, in case of this configuration, according to the arrangement of the long fibers, traces of the arranged long fibers may be formed on the surface of resin layer 1B. Therefore, faults may occur in electrodes 2 or resistor 3. In this case, according to the configure of the present embodiment, since the nonwoven fabric in which fibers are entangled without orientation is provided, traces of the arranged long fibers in a predetermined direction are not formed on the surface of resin layer 1B. If the surface of resin layer 1B becomes smooth, it is possible to remove faults from electrodes 2 or resistor 3.

Fourth Exemplary Embodiment

A heating element according to the present embodiment has the same configuration as the heating element shown in FIG. 10, but has the material of base substrate 1C different from the second embodiment. That is, a nonwoven fabric in which polyethylene terephthalate fibers are entangled, and a nonwoven fabric in which polyethylene terephthalate long fibers are arranged to be orthogonal to one another are laminated to be used as reinforcing layer 1A. In this case, reinforcing layer 1A is composed of a nonwoven fabric including first and second fibers. The first fibers are arranged in a predetermined direction to restrict retractility, and the second fibers are arranged to be orthogonal to the first fibers so as to restrict retractility. Since the long fibers have high tensile strength, the long fibers can restrict retractility in two directions that the first and second fibers are arranged to be orthogonal to each other. When one of the two directions agrees with a direction where a voltage is applied to resistor 3, it is possible to restrict the expansion and contraction in a direction where a resistance value is determined. As a result, it is possible to ensure stability of the resistance value. Since the heating element has retractility in directions except for the two directions, the heating element is mounted to a heated object having three-dimensional curved surfaces. Furthermore, since a direction where the heating element can expand and contract agrees with a direction where the retractility is required, the heating element can achieve retractility. Furthermore, since a direction where the heating element can expand and contract is not a direction which contributes to the resistance value of the heating element, it is possible to obtain the retractility and the stability of the resistance value at the same time. In addition, it is possible to adequately restrict the retractility of the heating element by the adjustment of the density of the long fibers. According to one preferred configuration of the present embodiment, the heating element may be configured so that the long fibers have high arrangement density in the direction where a voltage is applied to resistor 3. Because the long fibers are entangled, the entanglement of long fibers is firmed. As a result, it is possible to restrict the retractility of the heating element in a specific direction, and to improve the breaking strength thereof.

As described above, although the retractility of the heating element according to the present embodiment is restricted in two directions, the retractility thereof is not restricted in other direction. Therefore, the heating element can be mounted to a heated object having three-dimensional curved surfaces. In addition, by orienting a direction where the heating element can expand and contract to agree with a direction where the retractility is required, the heating element can have retractility. Furthermore, since a direction where the heating element can expand and contract is not a direction which contributes to the resistance value of the heating element, it is possible to obtain the retractility and the stability of the resistance value at the same time.

Fifth Exemplary Embodiment

A heating element according to the present embodiment has the same configuration as the heating element shown in FIG. 10, but has the configuration of base substrate 1C different from the fourth embodiment. That is, an angle between one of two main directions where long fibers serving as first fibers included in reinforcing layer 1A are arranged to be orthogonal to one another, and a direction where a voltage is applied to resistor 3 is a predetermined angle, that is, 22.5°. Since the long fibers have high tensile strength, the long fibers can restrict retractility in two directions that are arranged to be orthogonal to each other. An angle between the main directions and the direction where a voltage is applied to resistor 3 is 22.5°. For this reason, the retractility is restricted in the direction where a voltage is applied to resistor 3, and the retractility can be ensured in a direction orthogonal to the direction where a voltage is applied. The predetermined angle is not limited to 22.5°, and may be in the range of 0° to 90°. When the retractility needs to be restricted in the direction where a voltage is applied to resistor 3 according to the application of the heating element, it is preferable that the predetermined angle be in the range of 0° to 22.5°. In contrast, when the retractility needs to be restricted in a direction orthogonal to the direction where a voltage is applied to resistor 3, it is preferable that the predetermined angle be in the range of 22.5° to 90°. Due to the following reason, it is more preferable that the predetermined angle be 22.5°.

When the long fibers included in reinforcing layer 1A are arranged to be orthogonal to one another, the breaking strength of the base substrate 1C is increased. As a result, the retractility is restricted in the direction where a voltage is applied to resistor 3. However, since the retractility is restricted in a direction orthogonal to the direction where a voltage is applied to resistor 3, the entire retractility of the heating element is to be insufficient in some cases. Since the angle between one of two main directions where the long fibers are arranged to be orthogonal to one another, and the direction where a voltage is applied to resistor 3 is set to 22.5°, it is possible to maintain the retractility of the heating element in the direction where a voltage is applied to resistor 3, by a small angle. Further, it is possible to ensure the retractility of the heating element in a direction orthogonal to the direction where a voltage is applied to resistor 3, by a large angle.

As described above, although the retractility of the heating element according to the present embodiment is restricted in two directions, the retractility thereof is not restricted in other direction. Therefore, the heating element can be mounted to a heated object having a three-dimensional curved surface. In addition, by arranging a direction where the heating element can expand and contract to agree with a direction where the retractility is required, the heating element can achieve retractility. Furthermore, since a direction where the heating element can expand and contract is not a direction that contributes to the resistance value of the heating element, it is possible to obtain the retractility and the stability of the resistance value at the same time.

Resin layer 1B in the second to fifth embodiments is made of a thermoplastic urethane-based elastomer. However, the material of the resin layer is not limited thereto, and may be selected from various resins having a property and shape of an elastomer. For example, elastomer includes various elastomers such as a vulcanized elastomer, an unvulcanized elastomer, and a thermoplastic elastomer. In addition, a resin having a suppressed crystallinity formed using an improved polymerization or copolymerization method may be also selected as the resins having a property and shape of an elastomer.

A thermoplastic urethane-based elastomer is one of resins that have the most excellent property, and has an excellent retractility. Furthermore, the thermoplastic urethane-based elastomer can be processed to have a small thickness. However, the thermoplastic ester-based elastomer tends to swell by various solvents. For this reason, when the thermoplastic urethane-based elastomer is used as base substrate 1C, there are many cases where electrodes 2 and resistor 3 cannot be formed using a method of printing or applying on the thermoplastic urethane-based elastomer surface. That is, the thermoplastic urethane-based elastomer tends to swell by the solution contained in electrodes 2 or resistor 3. However, since reinforcing layer 1A suppresses the swelling of the thermoplastic urethane-based elastomer, the swelling does not occur in appearance.

A thermoplastic ester-based elastomer is similar to the thermoplastic urethane-based elastomer. Accordingly, even though the thermoplastic ester-based elastomer instead of the thermoplastic urethane-based elastomer is used in the second to fifth embodiments, it is possible to obtain the substantially same operation and effect as described above. Further, many of co-polyester resins whose melting point or crystallinity is lowered by the copolymerization have a property of an elastomer, and can be applied to the second to fifth embodiments.

Resin layer 6B in the second to fifth embodiments is made of co-polyester. However, the material of the resin layer is not limited thereto, and may be selected from flexible resins not lowering the property of the elastomer or resins having a property of an elastomer. Accordingly, resin layer 6B and resin layer 1B may be made of a same material, of a same kind of a thermoplastic resin differing in the melting point, or of different kinds of thermoplastic resins. The co-polyester used in the second to fifth embodiments may be replaced with an olefin-based resin having low crystallinity and a melting point of 120° C. or around, linear polyethylene having low density, or the like. Considering an adhesion to resin layer 1B and reinforcing layer 6A, resin layer 6B is preferable made of a resin having functional groups or an adhesive.

Sixth Exemplary Embodiment

A heating element according to the present embodiment has the same configuration as that of the heating element shown in FIG. 10, but is different from the second embodiment in the material composition of base substrate 1C. Specifically, resin layer 1B includes an olefin-based thermoplastic elastomer resin obtained by dynamic cross-linking of an ethylene/propylene resin and a propylene resin. This resin includes an ethylene/propylene resin moiety exhibiting elastomer properties and a propylene resin moiety exhibiting properties of a crystalline resin, which are block-shaped. The thermoplastic elastomer by dynamic cross-linking includes a block-shaped elastomer moiety, and therefore resin layer 1B having excellent elastomer properties and good retractility can be obtained.

The olefin-based thermoplastic elastomer has slightly lower elastomer properties, but has better solvent resistance, heat resistance and absorption rate, as compared to the thermoplastic urethane elastomer. The olefin-based thermoplastic elastomer obtained by dynamic cross-linking of the ethylene/propylene resin and the propylene resin has excellent rubber elasticity, but is not rather suitable to a thin-walled process, and thus resin layer 1B has the lower limit of processing of 120 μm in thickness. Due to this thickness, the heating element produced has high rigidity and is slightly reduced in flexibility and retractility when being felt with fingers. However, the heating element can be mounted to a heated object having a three-dimensional curved surface, and has restoring retractility and stability of resistance value, and thus is not greatly different from the second embodiment in terms of characteristics. A special feature is the fact that the heating element has solvent resistance and does not generate the swelling phenomenon, unlike when using the thermoplastic urethane elastomer in the second embodiment, and therefore has an appearance with good flatness accuracy and no feeling of distortion. Thus, the present embodiment clearly shows more improved solvent resistance than the second embodiment.

As described above, the heating element according to the present embodiment has advantages of particularly swelling resistance, and as a result, the heating element shows improved flatness accuracy. Furthermore, the heating element can be mounted to a heated object having a three-dimensional curved surface and be stretched. At the same time, it can exhibit stability of resistance value.

Seventh Exemplary Embodiment

A heating element according to the present embodiment has the same configuration as that of the heating element shown in FIG. 10, but is different from the sixth embodiment in the material composition of base substrate 1C. Specifically, resin layer 1B includes an olefin-based thermoplastic elastomer consisting of a propylene-based thermoplastic elastomer obtained by polymerization. The propylene-based thermoplastic elastomer obtained by polymerization is not block-shaped but a homogeneous elastomer resin, and has excellent flowability or stretchability during molding and has extremely excellent suitability to a thin-walled process, and thus resin layer 1B can be processed to the thickness of 50 μm. Due to this thickness, the heating element produced has proper rigidity and better flexibility and retractility when being felt with fingers, as compared to the sixth embodiment. Apparently similar to the sixth embodiment, the heating element does not generate the swelling phenomenon and therefore has an appearance with good flatness accuracy and no feeling of distortion.

As described above, the heating element according to the present embodiment has advantages of particularly proper rigidity and flatness accuracy. Furthermore, the heating element can be mounted to a heated object having a three-dimensional curved surface and be stretched. At the same time, it can exhibit stability of resistance value.

Eighth Exemplary Embodiment

A heating element according to the present embodiment has the same configuration as that of the heating element shown in FIG. 10, but is different from the second embodiment in the material composition of base substrate 1C. Specifically, resin layer 1B is made of an olefin-based thermoplastic elastomer consisting of an ethylene/propylene-based thermoplastic elastomer obtained by polymerization. The ethylene/propylene-based thermoplastic elastomer obtained by polymerization is a homogeneous elastomer resin, similar to the propylene-based thermoplastic elastomer obtained by polymerization, and has excellent flowability during molding and elastomer properties, and therefore, has extremely excellent suitability to a thin-walled process. Thus, resin layer 1B can be processed to the thickness of 50 μm. A special feature is the fact that the heating element has extremely low hardness. Resin layer 1B has extremely high flexibility due to low thickness of 50 μm and low hardness. Therefore, the heating element produced is more decreased in rigidity and has extremely excellent flexibility and excellent retractility when being felt with fingers. Apparently similar to the seventh embodiment, the heating element does not generate the swelling phenomenon and therefore has an appearance with good flatness accuracy and no feeling of distortion.

As described above, the heating element according to the present embodiment has advantages of particularly flexibility and flatness accuracy. Furthermore, the heating element can be mounted to a heated object having a three-dimensional curved surface and be stretched. At the same time, it can exhibit stability of resistance value.

Ninth Exemplary Embodiment

A heating element according to the present embodiment has the same configuration as that of the heating element shown in FIG. 10, but is different from the sixth embodiment in the material composition of base substrate 1C. Specifically, resin layer 1B is made of a blend of an olefin-based thermoplastic elastomer obtained by dynamic cross-linking of an ethylene/propylene resin and a propylene resin, and an olefin-based thermoplastic elastomer resin consisting of a propylene-based thermoplastic elastomer obtained by polymerization. The material composition of the sixth embodiment exhibits excellent rubber elasticity, but cannot be subjected to a thin-walled process. On the contrary, by blending the olefin-based thermoplastic elastomer resin obtained by the propylene-based thermoplastic elastomer obtained by polymerization, resin layer 1B can be processed to the thickness of 50 μm. A special feature of this configuration is the fact that the heating element has excellent rubber elasticity and can be subjected to a thin-walled process.

In the olefin-based thermoplastic elastomer obtained by dynamic cross-linking of an ethylene/propylene resin and a propylene resin, the ethylene/propylene resin moiety is cross-linked to have excellent rubber elasticity due to a three-dimensional cross-linking. However, it has trouble with flowability and stretchability and cannot be subjected to a thin-walled process. It is required to increase the amount of a propylene resin moiety in order to improve flowability, but there are limits to the increase in the amount thereof because the propylene resin moiety impairs rubber elasticity and increases the hardness.

On the contrary, the propylene-based thermoplastic elastomer obtained by polymerization is an olefin-based thermoplastic elastomer having good balance between flowability and rubber elasticity. Thus, by increasing the amount of the propylene-based thermoplastic elastomer by polymerization, not simply increasing the amount of the propylene resin moiety, it is possible to obtain excellent rubber elasticity and to perform a thin-walled process. Therefore, the heating element produced has low rigidity and good rubber elasticity, and extremely excellent flexibility and retractility when being felt with fingers. Apparently similar to the sixth embodiment, the heating element does not generate the swelling phenomenon and therefore has an appearance with good flatness accuracy and no feeling of distortion.

As described above, the olefin-based thermoplastic elastomer resin according to the present embodiment has flexibility and retractility similar to those of a thermoplastic urethane elastomer. The heating element using the resin has also advantages of particularly flexibility and retractility. Furthermore, the heating element can be mounted to a heated object having a three-dimensional curved surface and be stretched. And at the same time, it can exhibit stability of resistance value.

Further in the present embodiment, even when the blend of the ethylene/propylene-based thermoplastic elastomer obtained by polymerization is used as resin layer 1B, it is possible to perform the thin-walled process and to produce a heating element having more excellent flexibility.

Tenth Exemplary Embodiment

A heating element according to the present embodiment has the same configuration as that of the heating element shown in FIG. 10, but is different from the ninth embodiment in the material composition of base substrate 1C. Specifically, resin layer 1B includes a blend resin of an olefin-based thermoplastic elastomer obtained by dynamic cross-linking of an ethylene/propylene resin and a propylene resin, and a styrene-based thermoplastic elastomer synthesized by hydrogenation of a styrene/butadiene resin. As a result, resin layer 1B can be processed to the thickness of 50 μm, similar to the ninth embodiment. A special feature of this configuration is the fact that the heating element has excellent rubber elasticity and can be subjected to a thin-walled process, similar to the ninth embodiment. The styrene-based thermoplastic elastomer synthesized by hydrogenation of a styrene/butadiene resin is a thermoplastic elastomer resin having good balance between flowability and rubber elasticity. For this reason, similar to the ninth embodiment, by increasing the amount of the styrene-based thermoplastic elastomer, not simply increasing the amount of the propylene resin moiety, it is possible to obtain excellent rubber elasticity and to perform a thin-walled process. Therefore, the heating element produced has low rigidity and good rubber elasticity, and extremely excellent flexibility and retractility when being felt with fingers. Apparently similar to the sixth embodiment, the heating element does not generate the swelling phenomenon and therefore has an appearance with good flatness accuracy and no feeling of distortion.

As described above, the blend resin of the olefin-based thermoplastic elastomer and the styrene-based thermoplastic elastomer according to the present embodiment has flexibility and retractility similar to those of a thermoplastic urethane elastomer. The heating element using the resin has also advantages of particularly flexibility and retractility. Furthermore, the heating element can be mounted to a heated object having a three-dimensional curved surface and be stretched. At the same time, it can exhibit stability of resistance value.

Further, the blend of the resin is not limited to the combination of the ninth and tenth embodiments. It is possible to obtain excellent rubber elasticity and to perform a thin-walled process by combining a urethane-based, olefin-based and ester-based elastomer each having excellent elastomer properties and a resin exhibiting excellent stretchability during its melting. The elastomer is not generally good in stretchability during its melting, and in particular, it is not easy for the resin having excellent elastomer properties to be processed to a film having small thickness. On the other hand, a resin exhibiting high stretchability during its melting shows good stretching and is easy to process to be thin-walled. By incorporating a resin having high stretchability during its melting into a resin having excellent elastomer properties and low stretchability during its melting, it is possible to form resin layer 1B having small thickness and excellent elastomer properties. As the resin having high stretchability during its melting, a resin having low melt viscosity can achieve high stretchability and can be selected from many thermoplastic resins.

In particular, many kinds of styrene-based thermoplastic elastomer have extremely excellent elastomer properties and also excellent stretchability during its melting. However, because the styrene-based thermoplastic elastomer has insufficient heat resistance and solvent resistance, the styrene-based thermoplastic elastomer cannot be used alone and can be utilized because of excellent stretchability during melting thereof. The olefin-based thermoplastic elastomer is a resin having excellent heat resistance and solvent resistance. Therefore, the olefin-based thermoplastic elastomer as an elastomer resin and the styrene-based thermoplastic elastomer as a resin having excellent stretchability during melting are selected and blended to form resin layer 1B that is thin-walled and has excellent elastomer properties.

Further, the olefin-based thermoplastic elastomer obtained by dynamic cross-linking of the ethylene/propylene resin and the propylene resin as the elastomer and the olefin-based thermoplastic elastomer obtained by polymerization as the resin having excellent stretchability during melting may be used. This resin includes an ethylene/propylene resin moiety exhibiting elastomer properties by dynamic cross-linking of the ethylene/propylene resin and the propylene resin and a propylene resin moiety exhibiting properties of a crystalline resin, which are block-shaped. Because the thermoplastic elastomer obtained by dynamic cross-linking includes particularly the elastomer moiety having a block shape, the thermoplastic elastomer has excellent elastomer properties. On the other hand, the propylene-based thermoplastic elastomer obtained by polymerization is not block-shaped but a homogeneous elastomer, and has excellent stretchability during melting and particularly excellent suitability to a thin-walled process. It is possible to form resin layer 1B having excellent elastomer properties and small thickness by the combination of the resin having excellent elastomer properties and the resin having excellent stretchability during melting elastomer properties.

Eleventh Exemplary Embodiment

In the eleventh embodiment, resin layer 1B includes a blend resin of an olefin-based thermoplastic elastomer resin obtained by dynamic cross-linking of an ethylene/propylene resin and a propylene resin, an olefin-based thermoplastic elastomer by a propylene-based thermoplastic elastomer obtained by polymerization, and a polyolefin resin having functional groups introduced therein. The other configurations are the same as the ninth embodiment. A special feature of this configuration is the fact that the heating element naturally has excellent rubber elasticity and can be subjected to a thin-walled process, and the adherence of resin layer 1B to electrode 2 and resistor 3 is greatly improved.

Because resin layer 1B used in the ninth embodiment includes only the olefin-based resins, sufficient adherence may not be obtained depending on types of an electrically conductive paste. In particular, in applications requiring flexibility and retractility, the stress to electrode 2 and resistor 3 is extremely large and thus they may be separated from the surface of resin layer 18 and may be broken. As a result of the evaluation by 300000 times bending tests of the heat element according to the ninth embodiment, there are disconnecting due to separation at the probability that five electrodes of fifty four electrodes placed parallel to the direction in which a voltage is applied to resistor 3. On the other hand, the heating element according to the present embodiment includes resin layer 1B incorporated an olefin resin having functional groups introduced therein into the olefin-based elastomer. Thus, it has close adherence. Further, by introducing functional groups, the adherence between resin layer 1B and reinforcing layer 1A are improved and more efficient reinforcing effects are obtained. Therefore, even after 1500000 times bending tests, fifty four electrodes are not completely broken.

As described above, resin layer 1B according to the present embodiment includes the olefin-based thermoplastic elastomer, but has flexibility and retractility similar to the thermoplastic urethane elastomer. In addition, it is not swollen by a solvent contained in the electrically conductive paste and exhibits excellent adherence. The heating element using resin layer 1B of this type has physically flexibility and retractility. Therefore, the heating element can be mounted to a heated object having a three-dimensional curved surface and be stretched. At the same time, it can exhibit both of stability of resistance value and reliability for a long time.

In the present embodiment, resin layer 1B includes a resin in which the polyolefin resin having functional groups introduced therein is blended. Instead, the olefin-based thermoplastic elastomer may have functional groups introduced therein. In this case, it is not required to blend the polyolefin resin having functional groups introduced therein. Most thermoplastic elastomers have insufficient adherence with reinforcing layer 1A, or insufficient close adherence with coating films of the conductive paste and the resistor. However, by directly introducing functional groups into the thermoplastic elastomer resin, the adherence with reinforcing layer 1A or the close adherence with coating films of the conductive paste and the resistor can be improved.

Further, there are various types of the polyolefin resins having functional groups introduced therein, and the resin can be selected from a copolymerized polyolefin with vinyl acetate or acrylate, an ion-linked ionomer, and a polyolefin having maleic acid introduced by graft or copolymerization. Further, there are some kinds of thermoplastic elastomer other than the polyolefin-based one having functional groups introduced therein, and if necessary, the resin can be selected from these resins.

Twelfth Exemplary Embodiment

Figure 13A:
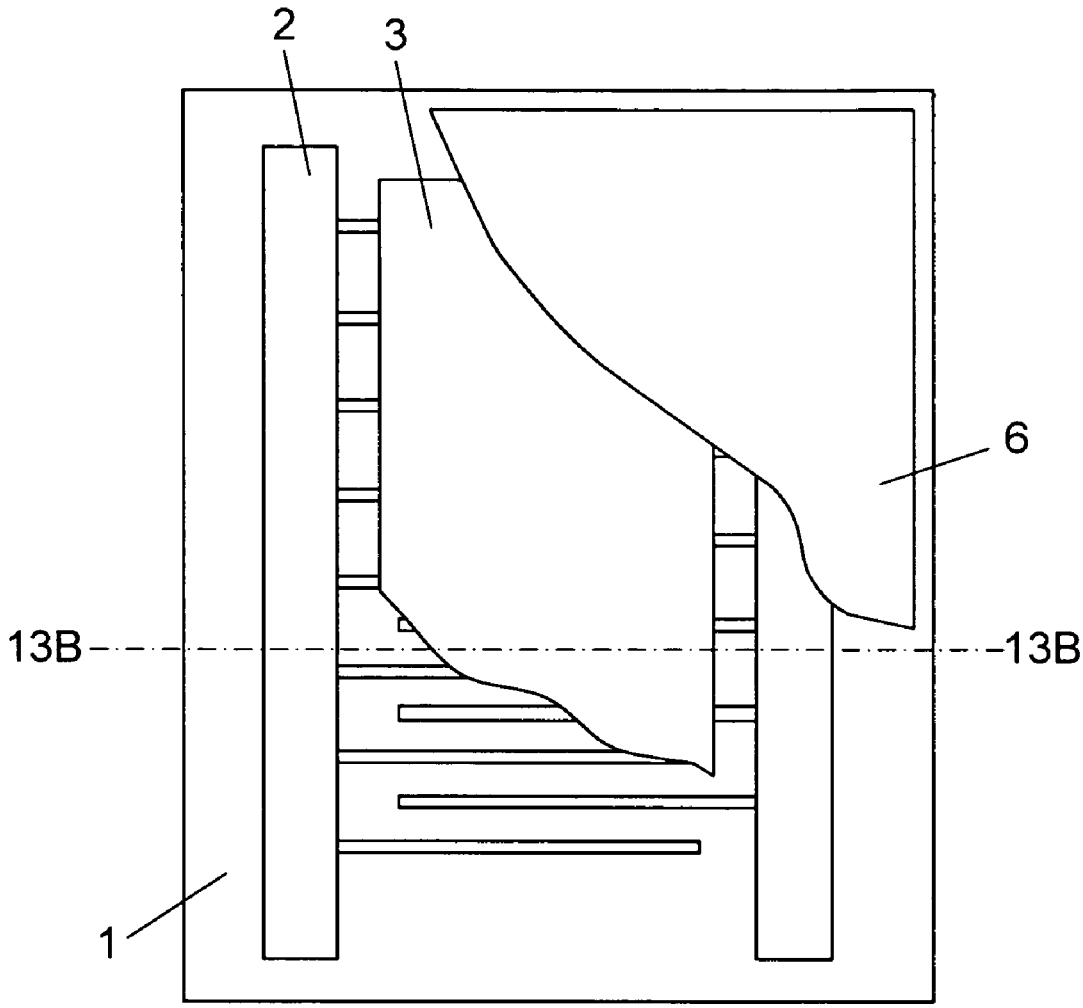
FIG. 13A is a cut-away plan view of a heating element according to twelfth and fourteenth exemplary embodiments of the present invention.
Figure 13B:
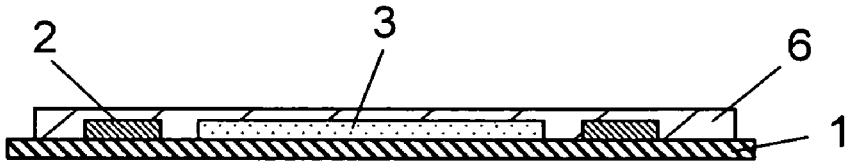
FIG. 13B is a sectional view of the heating element shown in FIG. 13A.

FIG. 13A is a schematic cut-away plan view showing a heating element according to the twelfth exemplary embodiment of the present invention, and FIG. 13B is a sectional view taken along line 13B-13B. The constructions of the heating element according to the present embodiment are as follows. Although not shown, the same terminal structure as in the first embodiment is formed in power supply parts of the electrodes 2.

Base substrate 1 having flexibility is a resin film having flame retardancy. Base substrate 1 includes 10% by weight of an ammonium phosphate-based flame retardant and 0.3% by weight of fine particles of polytetrafluoroethylene (PTFE) as a flame retardant aid, and the residues are resin components. These resin components include 70 parts of an olefin-based thermoplastic resin and 30 parts of an olefin-based adhesive resin. Base substrate 1 is formed to have a thickness of 50 to 60 μm by a T die extrusion. Although not shown, for handling in the processing thereafter, a releasing paper is used as a protective member to secure flatness.

Here, flexibility can be defined as a state where a material is not affected in the characteristics and maintains its durability, although modified in the shape under a suitable mechanical stress such as folding. That is, flexibility excludes the case where the shape cannot be changed, or the performances are lowered by the change in the shape. Further, there is a variety of flame retardancy which is rated as an HB grade, and a VO grade, but any one having reduced combustibility as compared with those which are not treated to be flame retardant may be used. A heating element can be handled as a final product, but it may be more often used in the state that it is assembled in another product. For this reason, in the case where cushioning materials or other resin substrates are used as a cover for a heating element, as long as the final product is designed for satisfying the flame retardancy requirements, the heat element itself does not need to satisfy the flame retardancy standards. It would be more preferable that the individual heat element itself satisfies the flame retardancy requirements for a product, and meets all the conditions including workability, costs, and the like.

A pair of comb-shaped electrodes 2 is arranged on base substrate 1 having flame retardancy and a resistor 3 is arranged at the position to be power-fed by electrode 2. Electrode 2 is formed by printing and drying of a silver paste. Resistor 3 is formed by printing and drying of a polymer resistor ink and is fabricated so as to have PTC characteristics and exothermic temperature of about 45° C. The polymer resistor ink is prepared by combining various ethylene vinyl acetate copolymers, kneading and cross-linking the resultant thing with carbon black, and making the resultant thing into an ink in a solvent by using acrylonitrile butyl rubber as a binder.

Armoring member 6 has the almost same resin composition as base substrate 1 and contains the same flame retardant and flame retardant aid as in base substrate 1 and is formed to have the same thickness by the same manner as in base substrate 1. Armoring member 6 is adhered to electrode 2 and resistor 3 to cover them.

The evaluation of automotive specifications for flame retardancy (FMVSS302) is conducted on the heating element having this configuration and the results thereof are that the combustion speed is decreased to half that of the case where the flame retardant is not completely used in the base substrate and the armoring member. When evaluated of flame retardancy by adhering to cushioning material of a car seat, the heating element can satisfy the specification requirements concerning flameproofing. Further, the heating element is not damaged in its flexibility even flame retardancy is provided; flexibility and flame retardancy are obtained.

The largest characteristics required for flame retardant are flame retardancy and do not affect electrical properties of resistor 3. Herein, the term "electrical properties" refers to resistance value, or resistance temperature characteristic if it has PCT characteristics. The higher a concentration of the flame retardant is, the higher flame retardancy the heating element has. However, when the content of the flame retardant is high, flexibility of armoring member 6 may be damaged and the processing cost may be high.

As the flame retardant, an organic flame retardant such as a phosphorus-based, phosphorus plus nitrogen-based and nitrogen-based compound, and an inorganic flame retardant such as a boron compound, antimony oxide, magnesium hydroxide and calcium hydroxide can be used. Among them, it is effective to use any one of phosphorus-based and nitrogen-based flame retardants or the combination thereof, as the flame retardant.

The nitrogen-based flame retardant has oxygen blocking properties (asphyxiating properties) and the phosphorus-based flame retardant has properties isolated from a combustible portion. Due to these properties, excellent flame-retardant effects can be exhibited. When the added concentration is 15% by weight or more, 50 mm/min or less of the combustion speed to the horizontal direction, which is the automotive specification for flame retardancy (FMVSS), is satisfied. Self-extinguishing properties can be satisfied when the added concentration is 20% by weight and noncombustibility can be satisfied when the added concentration is 25% by weight.

A halogen-based flame retardant is not preferable in that it has a high reactivity with silver used in electrode 2 and it has environmental problems. In particular, the combination ammonium polyphosphate as the phosphorus-based flame retardant and tris-(2-bydroxyethyl) isocyanurate as the nitrogen-based flame retardant has high flame retardant effects and is efficient.

Further, it is preferable to use the flame retardant having a melting point of 90° C. to 250° C. For example, noncombustibility can be obtained by the combination of 5% by weight of the phosphorus-based flame retardant having a melting point of 110° C. and 15% by weight of the nitrogen/phosphorus-based flame retardant. Such a fusible flame retardant reduces combustion heat by melting heat to have effects preventing combustion heat from being diffused.

Further, the flame retardant having a structure of ammonium phosphate is difficult to be pyrolyzed at high temperatures of about 250° C. and thus is advantageous in terms of workability.

As described above, it is preferable that a weight change of the flame retardant caused by an increase in temperature be small and the flame retardant have high thermal stability. Particularly, it is preferable that the weight be 99.5% or more relative to the weight measured at room temperature when the temperature is increased to 200° C. The weight change is experimentally evaluated using thermogravimetric (TG) analysis. Hereinafter, some evaluation results of the flame retardant using TG are shown.

Figure 14:
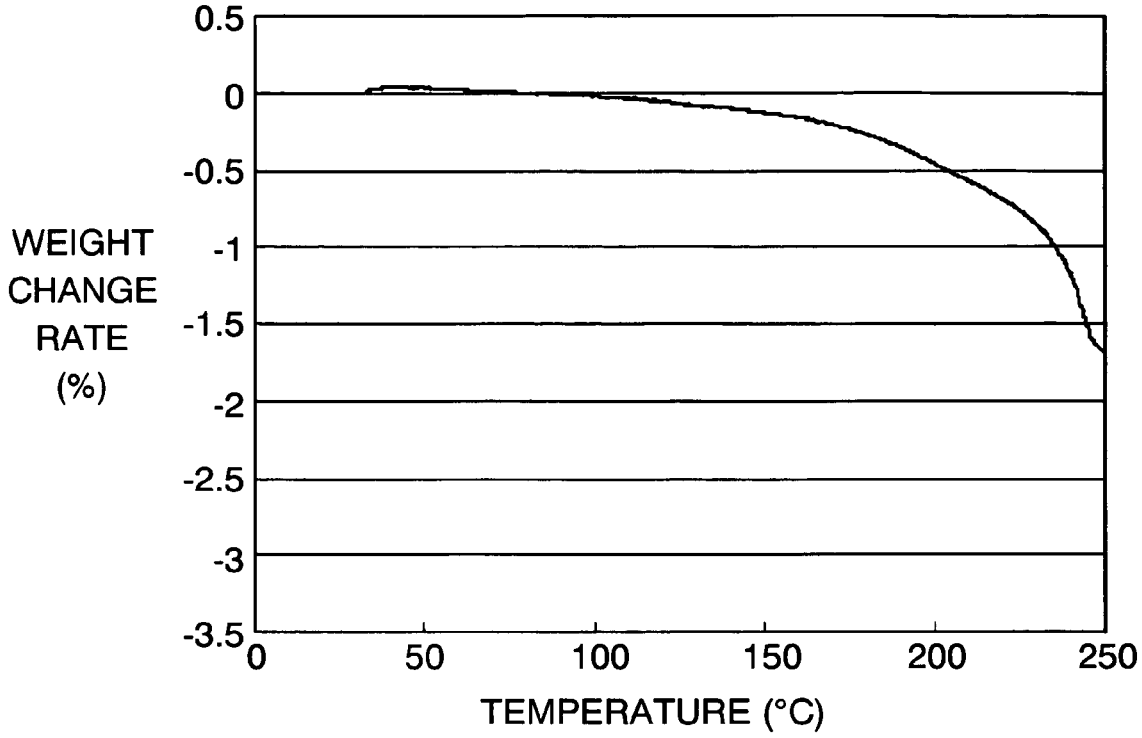
FIGS. 14 and 15 are characteristic views showing TG analysis results of a flame retardant of the heating element shown in FIG. 13A.
Figure 15:
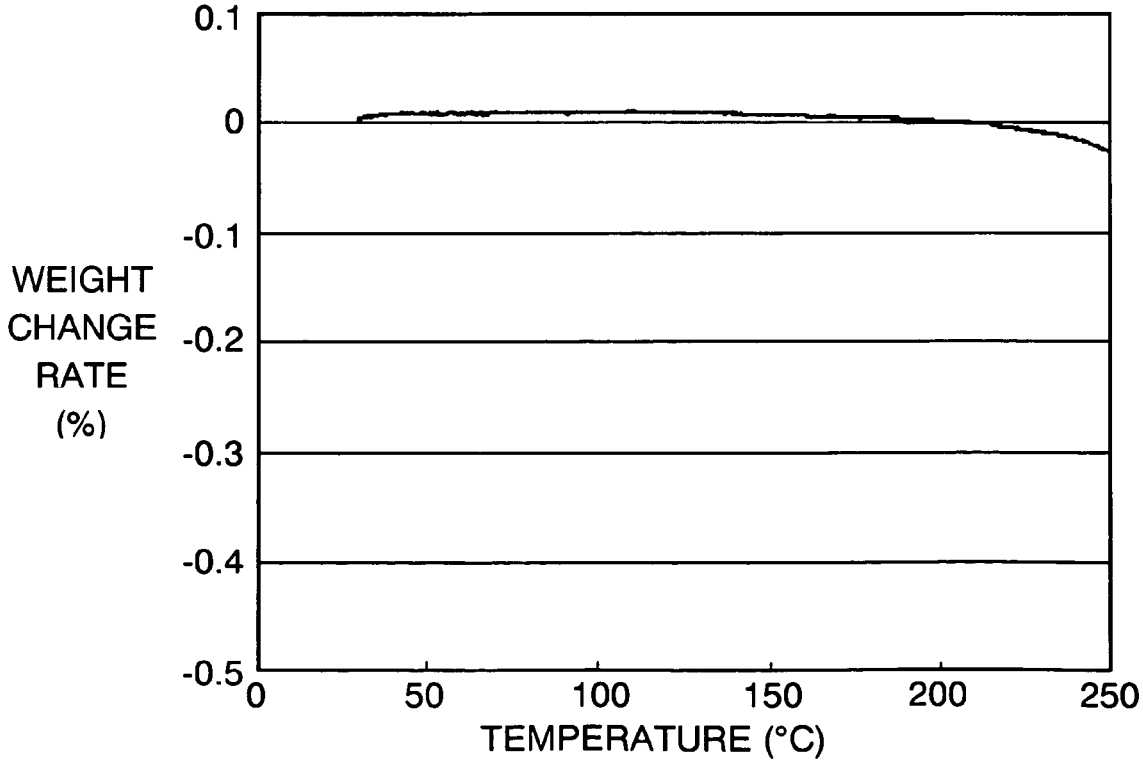

FIG. 14 is a graph showing evaluation results of a flame retardant using TG. As to the flame retardant, a phosphorus-based material and a nitrogen-based material are combined, and the flame retardant forms an adiabatic foaming carbide layer on a surface of a resin so as to provide flame retardancy to the resin. The weight change is about −0.4% when the temperature is increased from around 30° C., a room temperature, to 200° C. FIG. 15 is a graph showing the evaluation results of a nonhalogen-based flame retardant for polyolefin using TG. There is no weight change when the temperature is increased from around 30° C., a room temperature, to 200° C. Any of the two materials can be used for the resin layers 1B and 6B to provide flexibility and flame retardancy to the heating element.

In addition to the flame retardant, an additive may be appropriately used while the PTC characteristic of the resistor 3, or flexibility and flame retardancy of the heating element are not reduced. For example, a fluidity imparting agent, a flame retardant aid, an antifoaming agent, an antioxidant, or a dispersing agent may be added. As the fluidity imparting agent, a fluorine-based compound and a silicone reforming agent may be used alone or as a mixture thereof. The fluorine-based compound may act as the flame retardant aid of phosphorus, and be used for both purposes.

As the flame retardant aid, there is antimony oxide. As the antifoaming agent, powders of quicklime, silica gel, and zeolite may be used alone or as a mixture thereof. As the antioxidant, hindered phenols, amines, and sulfurs may be used alone or as a mixture thereof. Metal stearate may be used as the dispersing agent.

Thereby, the heating element that includes a material having polymers, such as resins or nonwoven fabrics, as a main component to realize flexibility and flame retardancy is obtained. Accordingly, the heating element may be easily applied to final products that require flame retardancy. In the above-mentioned constitution, base substrate 1 and the armoring member 6 both have flame retardancy. In this constitution, since a high flame retardant effect is realized, the heating element having high safety is obtained. However, a flame retardant material may be applied to any one of the two.

In the present embodiment, base substrate 1 and armoring member 6 both have the thermoplastic resin, but the thermoplastic resin may be included in any one. Thereby, the heating element having excellent workability and flexibility is obtained.

The flame-retardant resin film that is used in base substrate 1 and/or armoring member 6 may be produced through an inflation process, a press process, or a stretching process, instead of the T die process.

Thirteenth Exemplary Embodiment

Figure 16A:
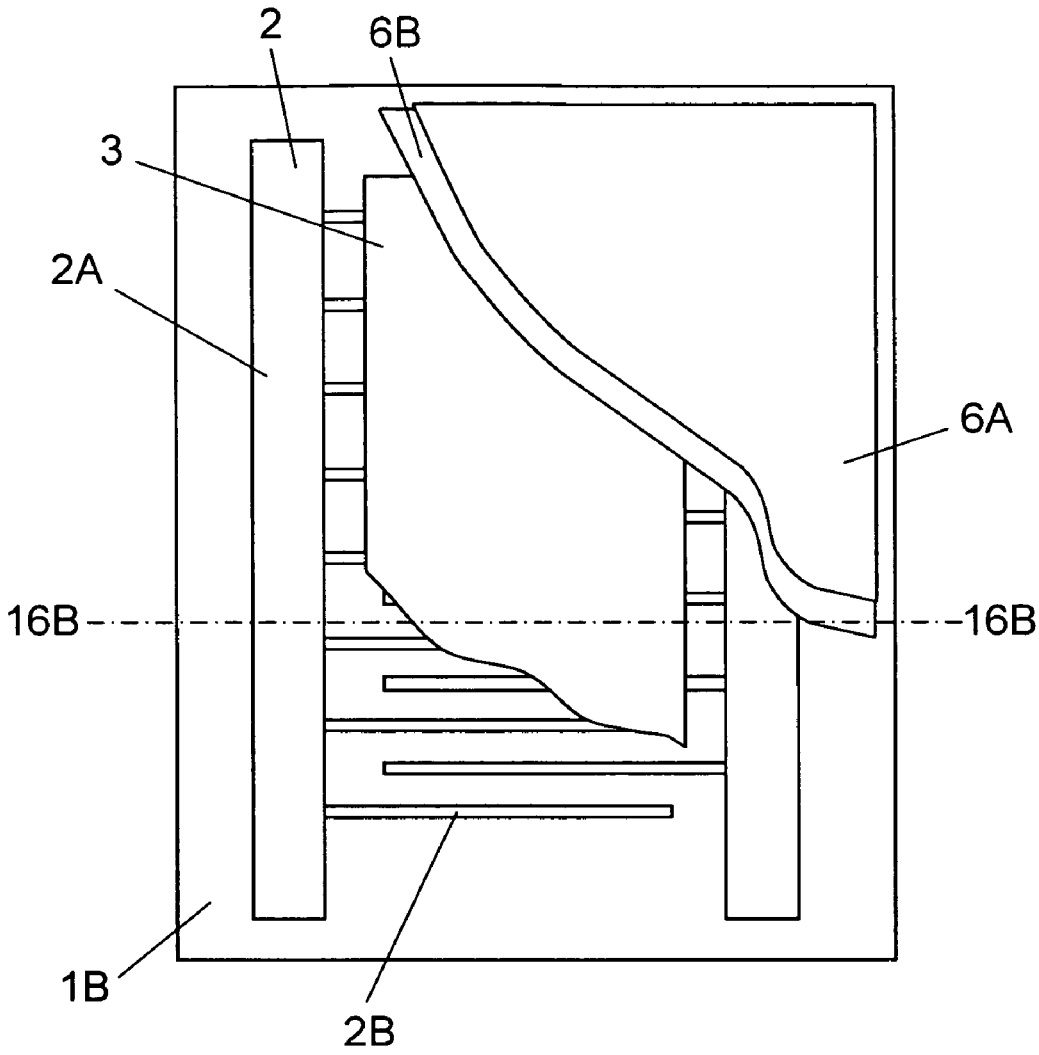
FIG. 16A is a cut-away plan view of a heating element of thirteenth and fifteenth exemplary embodiments of the present invention.
Figure 16B:
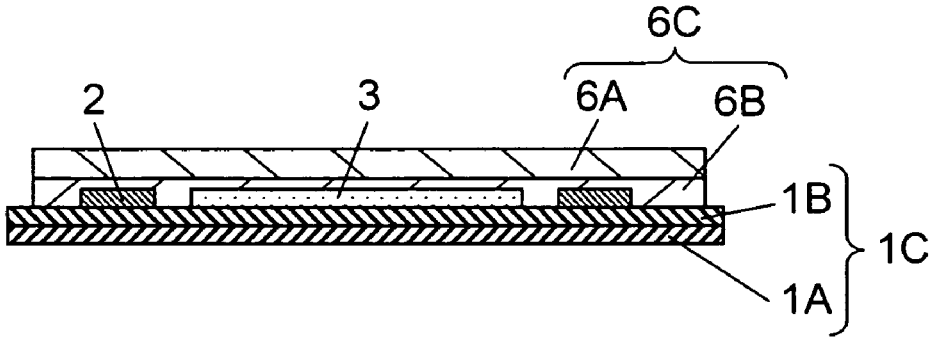
FIG. 16B is a sectional view of the heating element shown in FIG. 16A.

FIG. 16A is a schematic cut-away plan view showing a heating element according to the thirteenth exemplary embodiment of the present invention, and FIG. 16B is a sectional view taken along line 16B-16B. In the heating element according to present embodiment, base substrate 1C includes first resin layer (resin film) 1B, and first reinforcing layer 1A formed in the exterior thereof. Armoring member 6C includes second resin layer (resin film) 6B, and second reinforcing layer 6A formed in the exterior thereof. Reinforcing layers 1A and 6A are treated to make them flame retardant.

The other constitutions are the same as in the twelfth embodiment.

Reinforcing layer 1A is a spunbond (weight per unit area: 60 g/m$^2$) produced by thermal bonding of a spunlace (weight per unit area: 40 g/m$^2$) and a straight fiber of polyester (weight per unit area: 20 g/m$^2$). The spunlace is made of a polyester fiber copolymerized with a flame retardant. The straight fibers are arranged in the length direction of main electrode 2A of electrode 2, also in the direction where side electrodes 2B face with each other, which corresponds to the direction to be controlled of elongation, that is, a direction parallel to the direction for applying a voltage of resistor 3.

Resin layer 1B includes a resin composition made of 70% by weight of an olefin-based thermoplastic resin and 30% by weight of an olefin-based adhesive resin. Resin layer 1B is formed to have a thickness of 50 to 60 μm by a T die extrusion, and adhesively integrated with reinforcing layer 1A to constitute base substrate 1C.

Resin layer 6B is nearly the same resin composition to resin layer 1B, and adhered to reinforcing layer 6A. Reinforcing layer 6A is a niddle punch (weight per unit area: 150 g/m$^2$) including a flame retardant-impregnated polyester obtained by impregnating with a liquid flame retardant and then drying the liquid flame retardant. Resin layer 6B and reinforcing layer 6A are preliminarily joined by adhering using a laminator to constitute armoring member 6C.

For the heating element having such the constitution, if evaluation on the automotive specifications for flame retardancy (FMVSS302) is conducted, even when it is horizontally arranged, and lighted off from the end, the burning does not reach 38 mm of the gauge line, and is stopped. The flexibility of the heating element is not damaged even when it is provided with flame-retardancy, and flexibility and flame-retardancy are compatibilized.

For reinforcing layers 1A and 6A with flexibility having flame-retardancy provided therewith, those obtained by impregnating with a flame retardant, or a combination thereof, can be used, in addition to those obtained by copolymerizing with a flame retardant in the molecule as described previously. Those obtained by copolymerizing with a flame retardant in the molecule can use only limited kind of the flame retardants, but various liquid flame retardants are commercially available. For this reason, different types of the flame retardants may be combined to provide effective flame-retardancy.

The present embodiment illustrates the cases where only reinforcing layers 1A and 6A are treated to make them flame retardant, but resin layers 1B and 6B may be also treated to make them flame retardant. Depending on the conditions, or the ratio of flame retardancy of base substrate 1C and armoring member 6C, it is not necessary that both of them have the same content of the flame retardant and they may have any combination thereof. The ratio of flame retardancy may be determined according to the massive workability or the cost at the mass production of the heating element.

The present embodiment illustrates the cases where the flame retardant reinforcing layers are applied to both of base substrate 1C and armoring member 6C, the flame retardant reinforcing layer may be applied to any one according to a final product. Further, either of base substrate 1C and armoring member 6C may consist of the resin layer and the reinforcing layer, and the other may consist of the resin layer only. In this case, even when any one of the materials constituting base substrate 1C and armoring member 6C may be flame retardant, the heating element is flame retardant.

Further, the adhered product of the resin layer and the reinforcing layer can have flexibility by controlling of its strength using T die extrusion, an adhesive interlining, an adhesive, or a combination thereof. In particular, after resin layer 1B on which electrode 2 and resistor 3 are made has been subject to T die extrusion to adhere it to resin layer 6B, reinforcing layer 6A is preferably adhered to resin layer 6B with the adhesive interlining, the adhesive, or a combination thereof. In this manner, a heating element is obtained with excellent flexibility and massive productivity, as well as flame-retardancy. The adherence structure between base substrate 1C and armoring member 6C may be made in the opposite manner.

Usually, the adherence between the film made by T die extrusion and the nonwoven fabric or the woven fabric requires low cost because it allows one stage process. However, in such the state, the film resin contacts with the nonwoven fabric with high fluidity at a high temperature, and thus the film resin is impregnated in the nonwoven fabric. Base substrate 1C and armoring member 6C exhibit flexibility by the sliding between the polyester fibers of a nonwoven fabric, and if the film resin (the resin layer) is impregnated in the nonwoven fabric (the reinforcing layer), the sliding is suppressed, thus causing flexibility to be deteriorated.

In the present embodiment, the amount of the resin to be impregnated by T die extrusion can be controlled and thus base substrate 1C and armoring member 6C exhibit flexibility. The adhesive interlining constituted in the network formed by a thermally bondable resin partially bonds the nonwoven fabric with the film, thus flexibility can be maintained. With the use of an adhesive, the amount to be applied by spray coating, etc. is low, and flexible adhesive such as a styrene-based elastomer can be used, thus obtaining a heating element with excellent flexibility.

As such, the base substrate or the armoring member may consist of a resin film as in the twelfth embodiment. Alternatively, as in the present embodiment, it may include both of the resin layer made of the resin film and the reinforcing layer with flexibility, the representative of which is a woven fabric or a nonwoven fabric. That is, the base substrate or the armoring member may have a resin film which supports and covers electrodes 2 and resistor 3 as the minimum integrants which constitute a heating element.

When at least one of reinforcing layers 1A and 6A has a weight per unit area of at least 100 g/m$^2$ and at most 200 g/m$^2$, flexibility, cushioning property and texture can be imparted, thus the condition is effective for a seat heater to exhibit seat comfort. In particular, a niddle punch having a weight per unit area of 150 g/m$^2$ is for general purpose and requires low cost, thus it is most preferable. Alternatively, if flame retardant spunlace having a weight per unit area of at least 15 g/m$^2$ and at most 50 g/m$^2$ is used, the heating element can be adhesively integrated into other covering materials such as a bed sheet (or sheet) or leather, thus its application ranges is made wider. Further, if a flame retardant spunlace having an opening is used as reinforcing layer 6A, at a time of adhering through the opening, the resin layer 6B can be used as a thermal adhesive, and adhered to other members for use.

Further, the material for at least one of reinforcing layers 1A and 6A is preferably a stretchable material, specifically urethane-based, olefin-based, styrene-based or polyester-based thermoplastic elastomer or urethane foam. By this, flexibility, stretchability and cushionability are further improved, and thus a heating element with having excellent seat comfort is obtained.

Fourteenth Exemplary Embodiment

The basic constitution of a heating element in the present embodiment is the same as in FIGS. 13A and 13B used in the twelfth embodiment. In the present embodiment, resistor 3 is treated to have flame-retardancy. That is, the polymeric resistor ink constituting resistor 3 is prepared in the following manner.

First, various ethylene vinyl acetate copolymers which are crystalline polymers are combined, and the product is kneaded and cross-linked with carbon black which is a conductive fine particle. To the resultant thing, an acrylonitrile butyl rubber as a binder, an expanding agent having expanding graphite as a flame retardant are added. A solvent is used to make it into an ink, thus to prepare a polymeric resistor ink. When the expanding graphite is mixed with carbon black for use, the fluidity of the ink is improved, thus it causing easier printing. Using this ink, a heating element is formed as similar to the twelfth embodiment.

In the present embodiment, a flame retardant is not added to base substrate 1 and armoring member 6, and consists of 70 parts of an olefin-based thermoplastic resin and 30 parts of an olefin-based adhesive resin. The thickness and the preparation method are the same as in the twelfth embodiment.

For the heating element having such the constitution, if evaluation on the automotive specifications for flame retardancy (FMVSS302) is conducted, the burning speed is suppressed to half the value, as compared to the case where any flame retardant is not used in resistor 3. If flame retardancy is evaluated when the heating element is adhered to the cushioning material of a car seat, the product can satisfy the condition of the specifications for flame retardancy. Also, the flexibility of the heating element is not damaged even when it is provided with flame-retardancy, and flexibility and flame-retardancy are compatibilized.

The flame retardant contained in resistor 3 is not limited to the expanding graphite. The flame retardant as described in the twelfth embodiment may be employed. As described above, the flame retardant having a small change in weight caused by elevation of the temperature and high thermal stability is preferred. Specifically, it is preferable that the ratio of the weight when the temperature is elevated to 200° C. is 99.5% or more of the weight as measured at room temperature.

Figure 17:
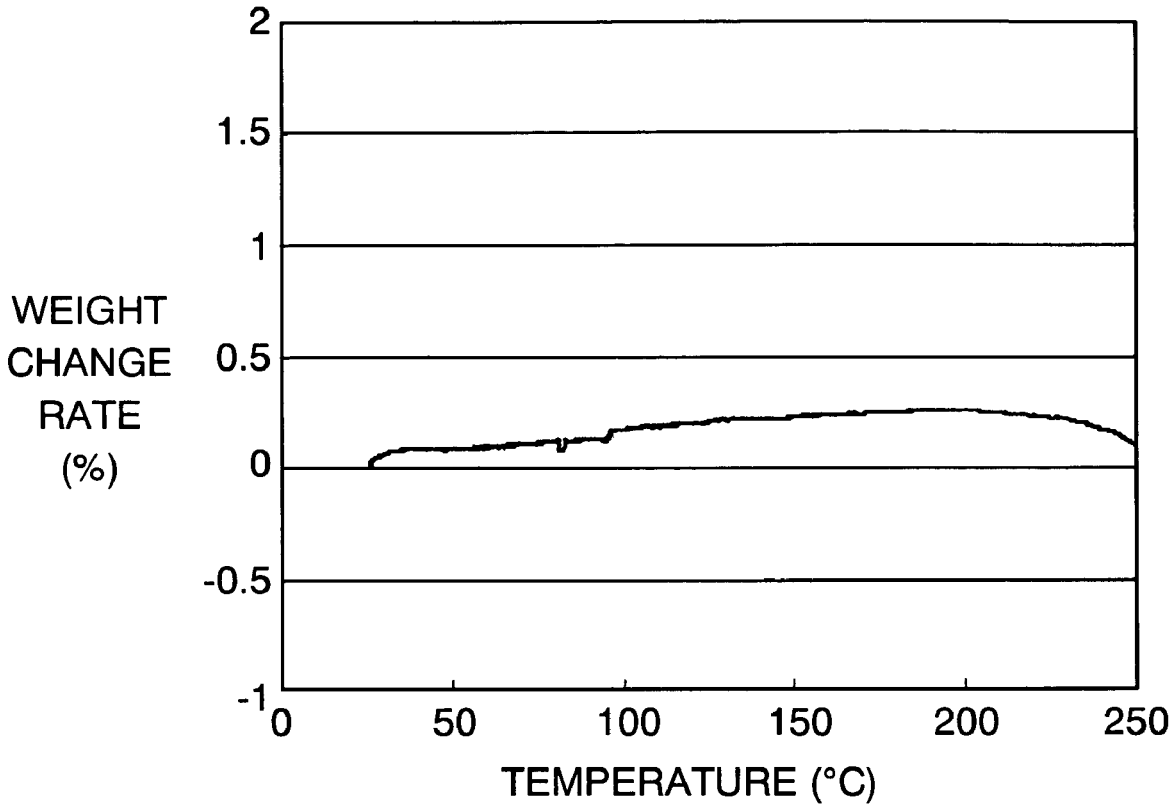
FIG. 17 is a characteristic view showing TG analysis results of a flame retardant of the heating element shown in FIG. 16A.
Figure 18A:
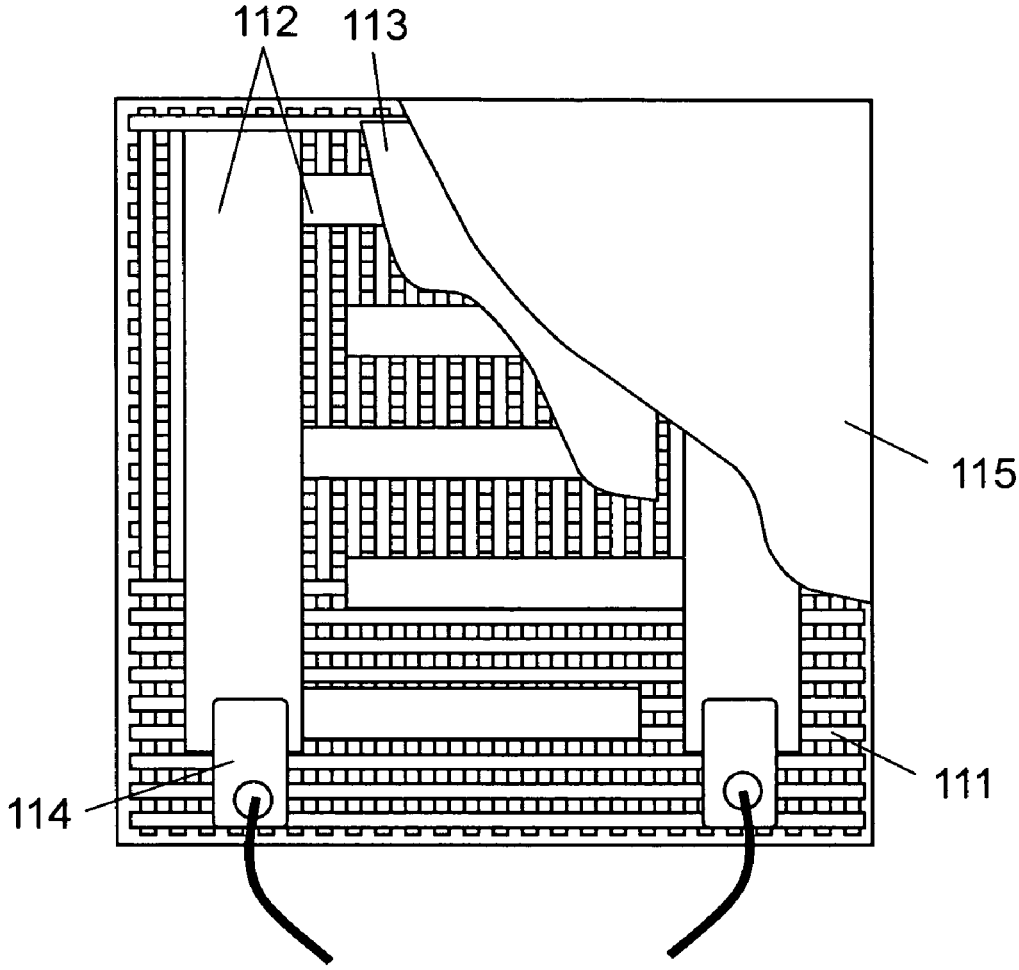
FIG. 18A PRIOR ART
FIG. 18A is a plan view of a conventional heating element.
Figure 18B:
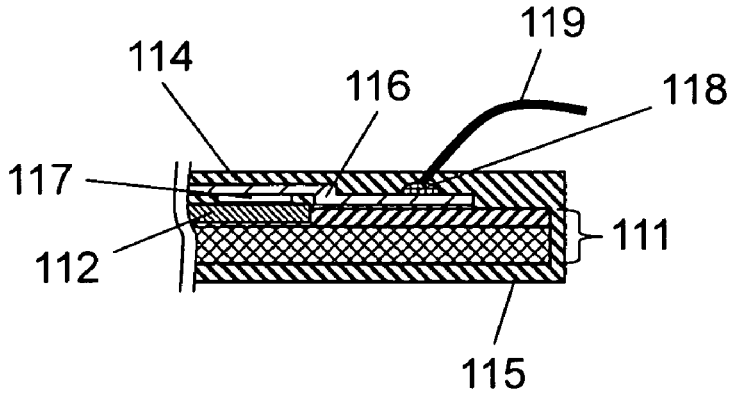
FIG. 18B PRIOR ART
FIG. 18B is a sectional view for a main portion of the heating element shown in FIG. 18A.

FIG. 17 is a graph showing the results of evaluation on 1,3-phenylene bisdixylenyl phosphate as one example of the phosphorous flame retardants by TG. The change in weight during the elevation of the temperature from around 30° C., room temperature, to 200° C. is about +0.3%. When such the material is contained as a flame retardant in resistor 3, the same effect is attained.

The present embodiment illustrates the cases where the flame-retardancy is imparted only on resistor 3, the constitution may be combined with those of twelfth and thirteenth embodiments. That is, by imparting the flame-retardancy performance on all of base substrate 1, armoring member 6, and resistor 3, the flame-retardancy performance is also further improved.

Fifteenth Exemplary Embodiment

The basic constitution of a heating element according to the present embodiment is the same as in FIGS. 16A and 16B shown in thirteenth embodiment. Difference between the heating element of the present embodiment and the heating element of the thirteenth embodiment lies on compositions of first resin layer 1B and second resin layer 6B. The other constitutions other than the above difference are the same as in the thirteenth embodiment.

Resin layer 1B includes a resin composition made of a blend of two kinds, i.e., polymerizable and compoundable olefin-based thermoplastic elastomers in equivalent amounts, and an olefin-based adhesive resin. The adhesive resin has an adhesive functional group such as maleic acid. This resin composition includes 70% by weight of a thermoplastic elastomer and 30% by weight of an adhesive resin. Resin layer 1B includes 5% by weight of flame retardants having combination of a phosphorous-based flame retardant and a nitrogen-containing flame retardant, 0.3% by weight of fine particles of polytetrafluoroethylene (PTFE) as a fluidity imparting agent, and 1.5% by weight of fine particles of silica gel as an antifoaming agent. By this composition, resin layer 1B has flexibility and flame-retardancy. Resin layer 1B is adhered to the spunlace surface of flame retardant, first reinforcing layer 1A with a thickness of 50 to 60 μm by T die extrusion.

Flame retardant resin layer 6B includes, as a main component, a resin composition made of 50 parts of a linear low-density polyethylene, 20 parts of a compoundable thermoplastic elastomer, and 30 parts of an olefin-based adhesive resin. Further, it includes 10% by weight of the flame retardant, 0.3% by weight of the fluidity imparting agent, and 1.5% by weight of the antifoaming agent, which are same as to those in resin layer 1B. Resin layer 6B is adhered to flame retardant second reinforcing layer 6A with a thickness of 50 to 60 μm by T die extrusion.

For the heating element having such the constitution, if evaluation on the automotive specifications for flame retardancy (FMVSS302) is conducted, even when it is horizontally arranged, and lighted off from the end, the burning does not reach 38 mm as the gauge line, and is stopped. The flexibility of the heating element is not damaged even when it is provided with flame-retardancy, and flexibility and flame-retardancy are compatibilized. In fact, the seat comfort when applied in a car seat, is evaluated to be equivalent to that of a known nonwoven fabric/linear type of a seat heater. The seat comfort as a seat heater has relationship with flexibility, stretchability, and cushionability, the heating element satisfies all of them.

The thermoplastic elastomer is used in resin layer 1B so as to impart flexibility, stretchability and heat resistance to the heating element. The adhesive resin is used so as to impart close adherence between the electrode 2 and the resistor 3 to the heating element. Heat resistance by a thermoplastic elastomer stands for that it can tolerate the drying temperature after printing electrode 2 or resistor 3. In the present embodiment, it should tolerate the atmosphere at 150° C. for about 30 minutes. For this reason, an olefin-based thermoplastic elastomer having a melting point of 170° C. is used. The flame retardant is used to impart flame retardancy. The properties, preferable materials, or the like, required for the flame retardant, are the same as for the flame retardant of the twelfth embodiment which is added to base substrate 1 or armoring member 6 including a resin film, so that the description thereon is omitted.

The higher concentration of the flame retardant to be added is, the higher flame-retardancy can be imparted. To the combination of resin layer 1B which 20% by weight of the flame retardant is added to and resin layer 6B which the same concentration of the flame retardant is added is the same as that of the flame retardant, it is not necessary to impart flame-retardancy on reinforcing layers 1A and 6A. That is, even when a known polyester nonwoven fabric is used for reinforcing layers 1A and 6A, the heating element has self-extinguishing property. Further, when the concentration of the flame retardant is set a 30% by weight, it can be made non-combustible under the same conditions. However, when the flame retardant is added to resin layers 1B and 6B, the melt viscosity is increased, the fluidity of the resin is lowered, elongation at high temperature is lowered, and thin films are hardly obtained therefrom. When the flame retardant is added in an amount of 15% by weight, the melt mass flow (MFR) is lowered from 3.5 to 0.5, as measured under a load of 5 kg at 210° C. In order to improve such the MFR, a fluidity imparting agent such as fine particles of PTFE as an additive is required. When the fine particles of PTFE are added in an amount of 0.3% by weight, the MFR is improved to a level of the MFR as obtained when a flame retardant is not added. Examples of the fluidity imparting agent include those which are added to the base substrate or the armoring member including a resin film in the twelfth embodiment.

Further, in order to produce a film from resin layers 1B and 6B, high molding temperature is required to enhance the fluidity of the materials in spite of T die extrusion or inflation molding. The molding temperature is usually 220° C. or higher, or in some cases, 250° C. or higher. At such high molding temperatures, due to the moisture adsorbed on the resin material or thermal decomposition of the resin material itself and the flame retardant itself slight amounts of gases are generated. In order to remove such the gases by adsorption, an antifoaming agent such as silica fine particles as an additive is preferably added in an amount of 1 to 2% by weight. By adding it, the foaming of the resin material is suppressed, thus it is possible to obtain a film having a predetermined thickness. Examples of the antifoaming agent include those which are added to base substrate 1 or armoring member 6 including a resin film in the twelfth embodiment.

Resin layer 6B includes an olefin-based resin, an adhesive resin, a flame retardant, and an additive. It is not necessary that resin layer 6B has heat resistance as high as that of resin layer 1B, but resin layer 6B is required to massively coat electrode 2 and resistor 3 by thermal bonding. For this reason, flexibility and processibility are imparted on the basis of the olefin-based resin having a melting point of around 110° C. The adhesive resin is used so as to impart close adherence with electrode 2 and resistor 3. In order to impart stretchability, a small amount of the olefin-based thermoplastic elastomer may be added. The flame retardant and the additive are the same as for resin layer 1B.

Hereinafter, other compositions of the resin composition which is contained in resin layer 1B will be described. The resin composition may have a combination of at least two of an olefin-based thermoplastic elastomer, a urethane-based thermoplastic elastomer, a styrene-based thermoplastic elastomer, in addition to the above-described combination. With this composition, a resin composition is obtained, in which the workability as the thermoplastic elastomer, the heat resistance of the olefin-based thermoplastic elastomer, the effect for improving the flexibility and the PTC characteristics of the urethane-based thermoplastic elastomer, and the flexibility of the styrene-based thermoplastic elastomer are leveraged.

Specifically, two are selected from the heat resistant olefin-based thermoplastic elastomer, the urethane-based thermoplastic elastomer and the styrene-based thermoplastic elastomer, in which one is blended in an amount of 30% by weight or more and 70% by weight or less, and the other is blended in an amount of 30% by weight or more and 70% by weight or less, and in which a dispersing resin with compatibility is blended in an amount of 30% by weight or less. Such the resin composition is used to form resin layer 1B, and to constitute a heating element. This heating element has excellent flexibility and stability in the resistance value even upon the vibration durability test.

For example, the olefin-based thermoplastic elastomer and the urethane-based thermoplastic elastomer are blended in the same weight, to which a nitrogen-containing flame retardant and a phosphorous flame retardant are added in an amount of 25% by weight, respectively, to prepare a resin composition.

Usually, the olefin-based thermoplastic elastomer and the urethane-based thermoplastic elastomer are not sufficiently compatible. However, the resin composition obtained by blending as described above has excellent stability in the resistance value in the duration test at 80° C., and thus it can be envisaged that the flame retardant functions as a compatible agent. Apparently, in order to promote the compatibility between the olefin-based thermoplastic elastomer and the urethane-based thermoplastic elastomer, it is preferable to add the dispersing resin with compatibility. For example, even when an ethylene-acrylic ester-maleic anhydride ternary copolymer resin is added as the dispersing resin with compatibility in an amount of 15% by weight, good resistivity stability is obtained.

The dispersing resin with compatibility is a modified polyolefin or modified thermoplastic elastomer, having a polar group such as a maleic anhydride group and a carboxylic acid group introduced, which can have a compatible structure imparted with affinity between different resins by a polar group. Examples of the modified polyolefin include an ethylene-vinyl acetate copolymerized resin, an ethylene-ethyl acrylate copolymerized resin, an ethylene-methyl methacrylate copolymerized resin, an ethylene-methacrylate copolymerized resin, and the like. Examples of the modified thermoplastic elastomer include a modified styrene-based thermoplastic elastomer, and the like.

Further, using the polar group, a flame retardant may be preliminarily masterbatched into a dispersing resin with compatibility, for example, at a concentration of 70% by weight, and then kneaded with the resin. By this, dispersibility of the flame retardant is increased to obtain a film.

By blending 30 to 70% by weight of an olefin-based thermoplastic elastomer, 30 to 70% by weight of a styrene-based thermoplastic elastomer, and 30% by weight or less of a dispersing resin with compatibility, a heating element using the blend has stable resistance value. For example, 45% by weight of an olefin-based thermoplastic elastomer, 45% by weight of a styrene-based thermoplastic elastomer, and 10% by weight of a dispersing resin with compatibility are blended to prepare a resin composition. 75% by weight of this resin composition and 25% by weight of a flame retardant are kneaded to constitute resin layer 1B with heat resistance and flame retardancy.

By blending 30 to 70% by weight of a styrene-based thermoplastic elastomer, 30 to 70% by weight of a urethane-based thermoplastic elastomer, and 30% by weight or less of a dispersing resin with compatibility, a heating element using the blend has stable resistance value. For example, 45% by weight of a styrene-based olefin-based thermoplastic elastomer, 45% by weight of a urethane-based thermoplastic elastomer, and 10% by weight of a dispersing resin with compatibility are blended to prepare a resin composition. 75% by weight of this resin composition and 25% by weight of a flame retardant are kneaded to constitute resin layer 1B with flame retardancy.

Next, other compositions of the resin composition which is contained in resin layer 6B will be described. The resin composition may have a combination of polyolefins which have a melting point of which difference from a melting point of the crystalline resin contained in resistor 3 is within 30° C. in addition to the above-described combination. Further, the resin composition may have a combination of such polyolefin and a thermoplastic elastomer. With this composition, resin layer 6B is constituted, which is similar to the thermal behavior, that is, the change in volume caused by the temperatures of resistor 3.

Specifically, the resin composition is blended with 30% by weight or more and 70% by weight or less of a polyolefin, 30% by weight or more and 70% by weight or less of a modified polyolefin, and 30% by weight or less of a dispersing resin with compatibility. Here, as the dispersing resin with compatibility, for example, a low molecular weight modified polyethylene wax can be used. For example, 45% by weight of a polyolefin, 45% by weight of a modified polyolefin, and 10% by weight of a dispersing resin with compatibility are blended to prepare a resin composition. With 75% by weight of this resin composition, 25% by weight of a flame retardant is kneaded to obtain resin layer 6B with adhesiveness and flame retardancy.

As a dispersing resin with compatibility, modified polyolefin having a polar group such as a maleic anhydride group and a carboxylic acid group introduced, may be used.

Further, when the resin composition includes 30 to 70% by weight of a polyolefin, 30 to 70% by weight of a thermoplastic elastomer, and 30% by weight or less of a dispersing resin with compatibility, a flexible heating element having excellent stable resistivity is obtained.

In addition, a resin composition may include 30 to 70% by weight of a modified polyolefin, 30 to 70% by weight of a thermoplastic elastomer, and 30% by weight or less of a dispersing resin with compatibility. As the thermoplastic elastomer, a urethane-based thermoplastic elastomer or a styrene-based thermoplastic elastomer may be used.

Uniformly dispersing a flame retardant in a resin composition is very important to obtain a film of resin layers 1B and 6B, and by using the dispersing resin with compatibility to make a masterbatch, a resin composition having high flame-retardancy and suitability for making a film can be obtained with high reproductively.

In the present embodiment, all of reinforcing layers 1A and 6A, and resin layers 1B and 6B have flame-retardancy, but resin layers 1B and 6B only may include materials having flame-retardancy.

As described above, the present invention is illustrated with reference to the exemplary embodiments, but is not limited to the embodiments and the numerical values or materials as defined therein so as to attain the same functions and effects. Further, even when the specific constitution of each embodiment is carried out in a separate manner from the terminal structure as described in the first embodiment, inherent effects are exhibited.

INDUSTRIAL APPLICABILITY

According to the configuration of a heating element according to the present invention, it is possible to form a power supply part at an optional position. The power supply has high allowable current, high reliability, and high productivity. Therefore, the present invention is useful in the cases a large current is required because a voltage of a power supply is low or a heating element is formed having a positive resistance temperature characteristic where a large inrush current is required in order to obtain flash heating.

The invention claimed is:

1. A heating element, comprising:

a base substrate;

a pair of electrodes formed on the base substrate;

a resistor formed between the pair of electrodes and capable of generating heat;

a conductive resin formed on each of the electrodes and including a thermosetting material;

a terminal member formed on the conductive resin;

a hot melt adhesion metal formed on the terminal member;

a hot melt cohesion metal forming a molten phase along with the adhesion metal;

a lead wire having an end to which the cohesion metal is bonded by hot-melting, and an armoring member covering the pair of electrodes, the resistor, the terminal member, and the adhesion metal, the armoring member being provided with a through hole, wherein the conductive resin is formed in the vicinity of the adhesion metal so that the conductive resin is affected by heat of the adhesion metal and the cohesion metal;

the molten phase is formed via the through hole and between the cohesion metal and the adhesion metal; and each of the electrodes includes resin and conductive powder dispersed in the resin.

2. The heating element according to claim 1, wherein an adhesion surface of the terminal member and the conductive resin is roughed.

3. The heating element according to claim 1, wherein the terminal member is an electrolytic metal foil.

4. The heating element according to claim 1, wherein the terminal member is a rolled metal foil.

5. The heating element according to claim 1, wherein the terminal member is a metal plate having a surface plated with another type of metal.

6. The heating element according to claim 1, wherein the conductive resin and an adhesive material are juxtaposed on an adhesion surface of the terminal member and each of the electrodes.

7. The heating element according to claim 1, wherein the conductive resin contains a curing agent having limited reactivity at a predetermined temperature or lower.

8. The heating element according to claim 1, wherein the conductive resin contains a resin that has copolyester as a main component, and a block-type isocyanate curing agent having limited reactivity at a predetermined temperature or lower.

9. The heating element according to claim 1, wherein the conductive resin and the electrodes contain a same type of resin.

10. The heating element according to claim 1, wherein the base substrate includes a first resin layer having a property of an elastomer, and a first reinforcing layer, the pair of electrodes is formed on the first resin layer, the armoring member includes a second resin layer bonded to the first resin layer by hot-melting and a second reinforcing layer, and at least one of the first reinforcing layer and the second reinforcing layer restricts retractility in a direction where voltage is applied to the resistor.

11. The heating element according to claim 10, wherein at least one of the first reinforcing layer and the second reinforcing layer includes a first fiber restricting the retractility arranged in a predetermined direction.

12. The heating element according to claim 11, wherein the direction where the first fiber are arranged and the direction where voltage is applied to a resistor meet at an angle of more than 0° and less than 90° to each other.

13. The heating element according to claim 11, wherein at least one of the first reinforcing layer and the second reinforcing layer is at right angle to the first fiber, and includes a second fiber restricting the retractility.

14. The heating element according to claim 10, wherein at least one of the first reinforcing layer and the second reinforcing layer includes a nonwoven fabric that is formed through entanglement of fibers.

15. The heating element according to claim 14, wherein at least one of the first reinforcing layer and the second reinforcing layer further includes a first fiber arranged in a predetermined direction restricting retractility, and at least one of the first resin layer and the second resin layer is formed on a face of the nonwoven fabric.

16. The heating element according to claim 10, wherein the first resin layer includes a resin material that is not melted at a melting point of the second resin layer.

17. The heating element according to claim 10, wherein the first resin layer includes a propylene-based thermoplastic elastomer caused by a polymerization reaction.

18. The heating element according to claim 10, wherein the first resin layer includes an ethylene propylene-based thermoplastic elastomer caused by a polymerization reaction.

19. The heating element according to claim 10, wherein the first resin layer includes an elastomer and a stretchable resin when melted.

20. The heating element according to claim 19, wherein the elastomer is an olefin-based thermoplastic elastomer, and the stretchable resin is a styrene-based thermoplastic elastomer when melted.

21. The heating element according to claim 10, wherein the first resin layer is a material that is swollen by a solvent contained when at least one of the electrodes and the resistor is formed, and the first reinforcing layer suppresses expansion caused by swelling of the first resin layer.

22. The heating element according to claim 10, wherein the first resin layer includes the olefin-based elastomer and an olefin resin having a functional group.

23. The heating element according to claim 10, wherein at least one of conditions is satisfied;

the first reinforcing layer is reinforced by impregnation of the first resin layer in the base substrate, the second reinforcing layer is reinforced by impregnation of the second resin layer in the armoring member.

24. The heating element according to claim 1, wherein at least one of the base substrate, the armoring member, and the resistor has flame retardancy.

25. The heating element according to claim 24, wherein at least one of the base substrate and the armoring member is a resin film.

26. The heating element according to claim 24, wherein at least one of the base substrate and the armoring member includes a resin film, and the heating element further includes a reinforcing layer covering an external surface of the resin film.

27. The heating element according to claim 26, wherein the reinforcing layer has flame retardancy, and is any one of a woven fabric and a nonwoven fabric.

28. The heating element according to claim 24, wherein at least one of the base substrate and the armoring member includes a thermoplastic resin.

29. The heating element according to claim 24, wherein at least one of the base substrate, the armoring member, and the resistor includes at least one of a phosphorus-based flame retardant and a nitrogen-based flame retardant.

30. The heating element according to claim 24, wherein the resistor includes a crystalline polymer, fine conductive powder, and a flame retardant.

31. The heating element according to claim 30, wherein the flame retardant includes expanded graphite.

32. The heating element according to claim 24, wherein at least one of the base substrate, the armoring member, and the resistor includes a flame retardant that has a weight change rate of at most 0.5% when a temperature thereof is increased to 200° C.

33. The heating element according to claim 1, wherein the base substrate includes a first resin layer having flexibility and a first reinforcing layer that has flexibility and is adhered to the first resin layer, the armoring member includes a second resin layer that has flexibility and is adhered to the first resin layer and a second reinforcing layer that has flexibility and is adhered to the second resin layer, the pair of electrodes is formed on the first resin layer, and at least one of the first resin layer, the second resin layer, the first reinforcing layer, and the second reinforcing layer has flame retardancy.

34. The heating element according to claim 33, wherein at least one of the first reinforcing layer and the second reinforcing layer includes at least one of a nonwoven fabric in which a flame retardant is copolymerized in molecules and a nonwoven fabric in which the flame retardant is impregnated.

35. The heating element according to claim 33, wherein the first resin layer includes a thermoplastic elastomer, an adhesive resin, and a flame retardant.

36. The heating element according to claim 35, wherein the first resin layer further includes an antifoaming agent containing at least one of quicklime powder, silica gel powder, and zeolite powder.

37. The heating element according to claim 35, wherein the second resin layer includes an olefin-based resin, the adhesive resin, and the flame retardant.

38. The heating element according to claim 37, wherein the second resin layer further includes an antifoaming agent containing at least one of quicklime powder, silica gel powder, and zeolite powder.

39. The heating element according to claim 37, wherein a weight per area of at least one of a first reinforcing layer and a second reinforcing layer is at least 100 $g/m^2$ and at most 200 $g/m^2$.

40. The heating element according to claim 33, wherein at least one of the first reinforcing layer and the second reinforcing layer includes a stretchable material.

41. The heating element according to claim 33, wherein the first resin layer has heat resistance and is bonded to the first reinforcing layer by hot-melting, and the second reinforcing layer is adhered to the second resin layer.

42. The heating element according to claim 33, wherein the first reinforcing layer includes a flame-retardant spunlace, and a spunbond that contains fibers arranged parallel to a direction where voltage is applied to the resistor.

43. The heating element according to claim 33, wherein the second reinforcing layer includes any one of a flame-retardant needle punch having a weight per area of at least 100 $g/m^2$ and at most 200 $g/m^2$, and a flame-retardant spunlace having a weight per area of at least 15 $g/m^2$ and at most 50 $g/m^2$.

44. The heating element according to claim 33, wherein the first resin layer includes at least 30 wt % and at most 70 wt % of a olefin-based thermoplastic elastomer, at least 30 wt % and at most 70 wt % of a styrene-based thermoplastic elastomer, at most 30 wt % of a dispersing resin with compatibility, and a flame retardant.

45. The heating element according to claim 44, wherein the dispersing resin with compatibility includes at least one of modified polyolefin having a polar group and modified thermoplastic elastomer.

46. The heating element according to claim 33, wherein the first resin layer includes a polyolefin having a melting point of which difference from a melting point of a crystalline resin contained in the resistor is within 30° C., and a flame retardant.

47. The heating element according to claim 33, wherein the second resin layer includes at least 30 wt % and at most 70 wt % of a polyolefin, at least 30 wt % and at most 70 wt % of a thermoplastic elastomer, at most 30 wt % of a dispersing resin with compatibility, and a flame retardant.

48. The heating element according to claim 47, wherein the dispersing resin with compatibility includes at least one of modified polyolefin having a polar group and modified thermoplastic elastomer.

49. The heating element according to claim 33, wherein at least one of the first resin layer and the second resin layer further includes a flame retardant containing at least one of a nitrogen-based flame retardant and a phosphorus-based flame retardant.

50. The heating element according to claim 33, wherein at least one of the first resin layer and the second resin layer includes a flame retardant containing a phosphorus-based flame retardant having a melting point of 90 to 250° C.

* * * * *